United States Patent [19]

Sanchez et al.

[11] Patent Number: 4,844,781

[45] Date of Patent: Jul. 4, 1989

[54] ELECTROCHEMICAL METHOD OF SURFACE TREATING CARBON; CARBON, IN PARTICULAR CARBON FIBERS, TREATED BY THE METHOD, AND COMPOSITE MATERIAL INCLUDING SUCH FIBERS

[75] Inventors: Manuel Sanchez, Villier Le Bel; Georges Desarmot, Paris; Blandine Barbier, Rueil Malmaison, all of France

[73] Assignee: Office National D'Etudes et de Recherches Aerospatiales, Chatillon-Sous-Bagneux, France

[21] Appl. No.: 126,791

[22] Filed: Dec. 1, 1987

[30] Foreign Application Priority Data

Dec. 2, 1986 [FR] France ..... 86 16841

[51] Int. Cl.[4] ..... C25F 5/00

[52] U.S. Cl. ..... 204/132; 204/130

[58] Field of Search ..... 204/130, 132

[56] References Cited

U.S. PATENT DOCUMENTS 4,690,738 9/1987 Desarmot et al. ..... 204/130

4,704,196 11/1987 Saito ..... 204/130

FOREIGN PATENT DOCUMENTS 1433712 4/1976 United Kingdom .

OTHER PUBLICATIONS

Search Report for French Appln. No. 86 16 841.

*Primary Examiner*—John F. Niebling

*Assistant Examiner*—S. Marquis

*Attorney, Agent, or Firm*—Armstrong, Nikaido, Marmelstein, Kubovcik & Murray

[57] ABSTRACT

The method is of the type in which carbon (3) is put into contact with a solution (2) of an amine compound in a bipolar solvent with the carbon being positively polarized relative to a cathode (5). According to the invention, the solvent is an organic compound, preferably an aprotic compound, having a high anode oxidation potential, and the solution is practically free from water.

15 Claims, 21 Drawing Sheets

I $V_{sol}$
non aqueous medium
aqueous medium
$V_t$
$V_E$
$I_0$
0
V
$V_0$
aqueous medium
$V_t$
non aqueous medium

+
-
16
19
10
15
11
14
14
13
12
17
18

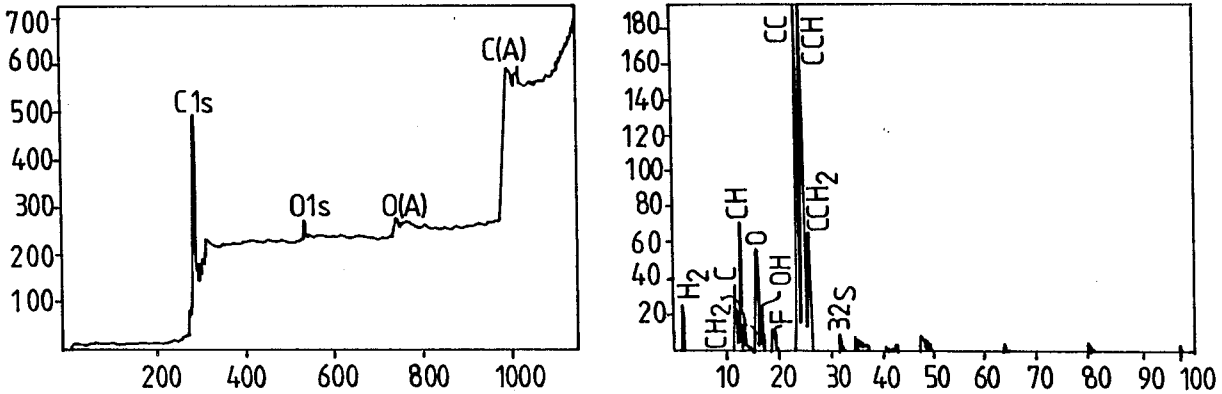
FIG. 6a
FIG. 6b
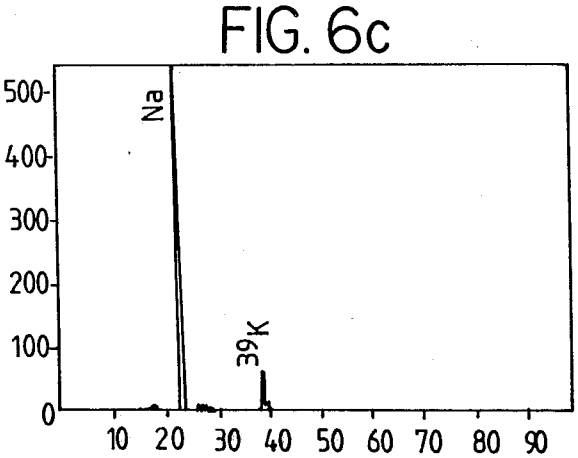
FIG. 6c

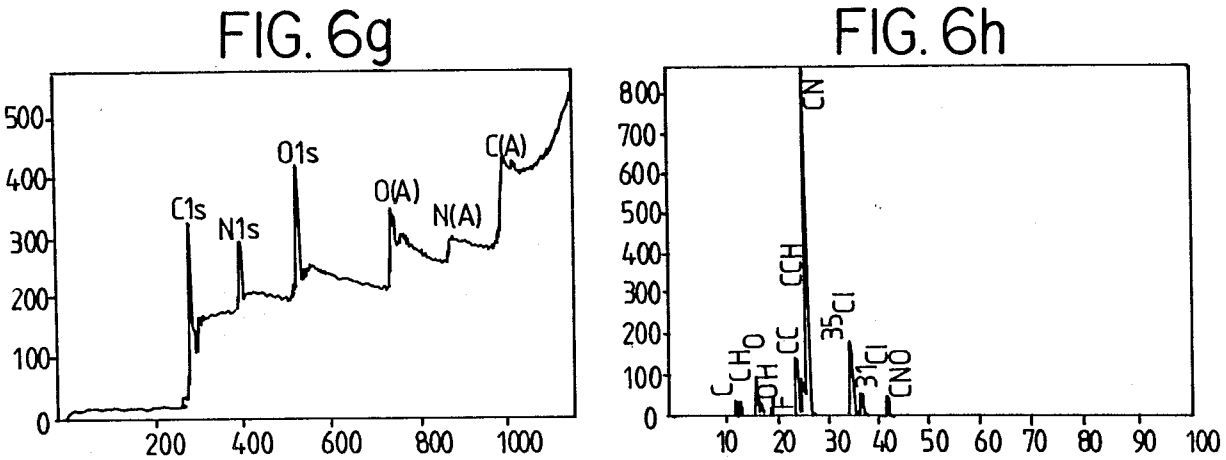
FIG. 6g
FIG. 6h
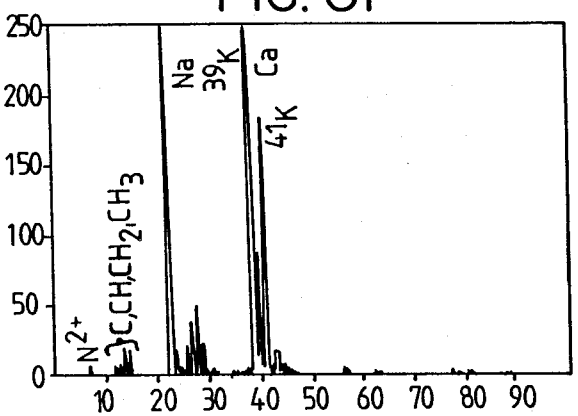
FIG. 6i

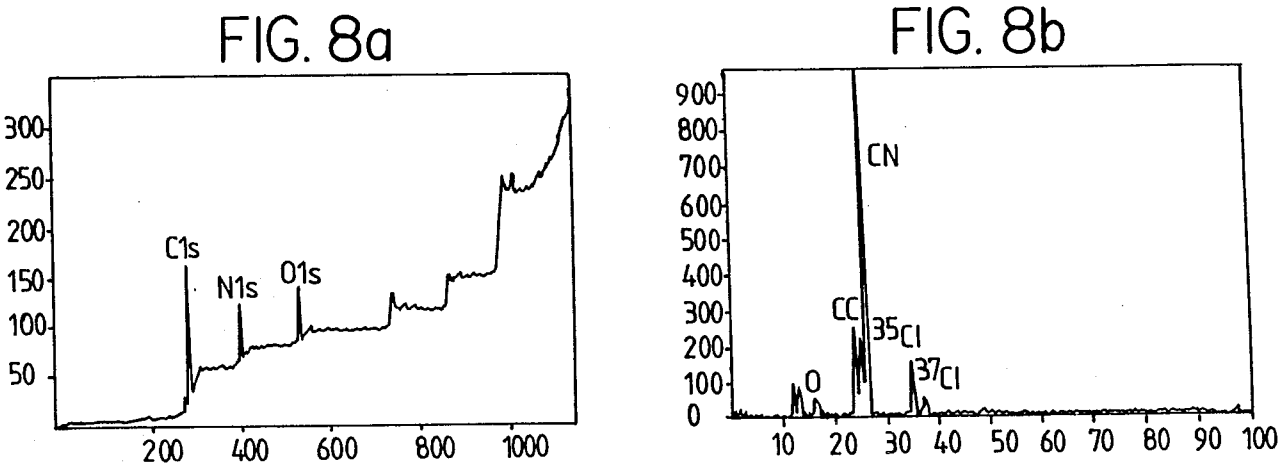
FIG. 8a
FIG. 8b
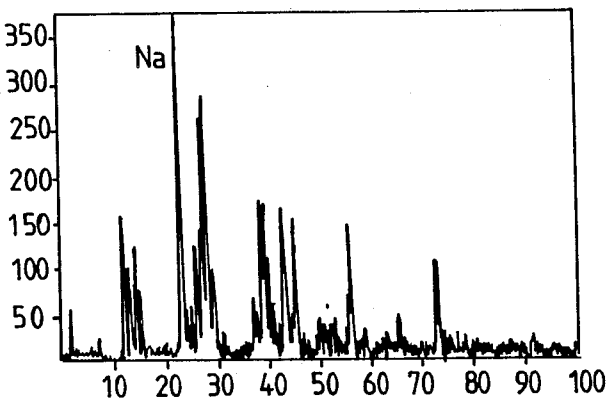
FIG. 8c

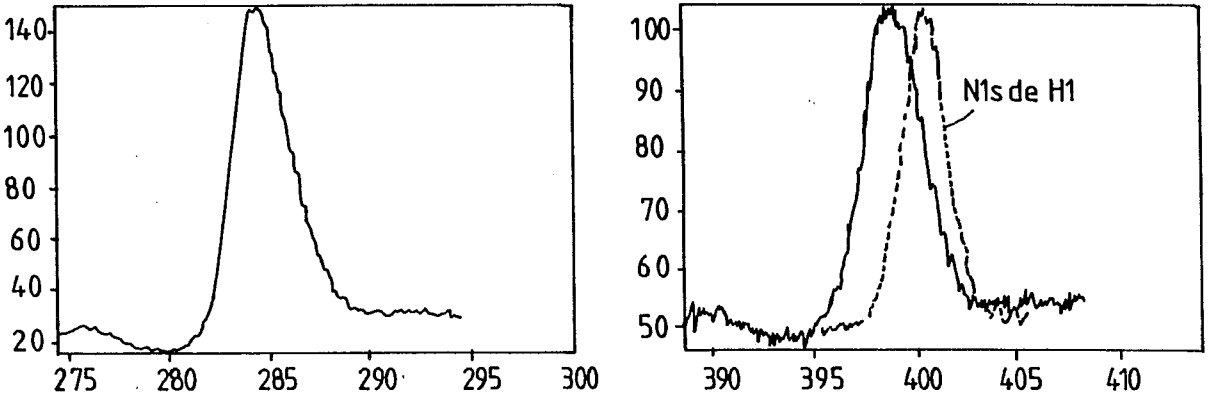
FIG. 8d
FIG. 8e
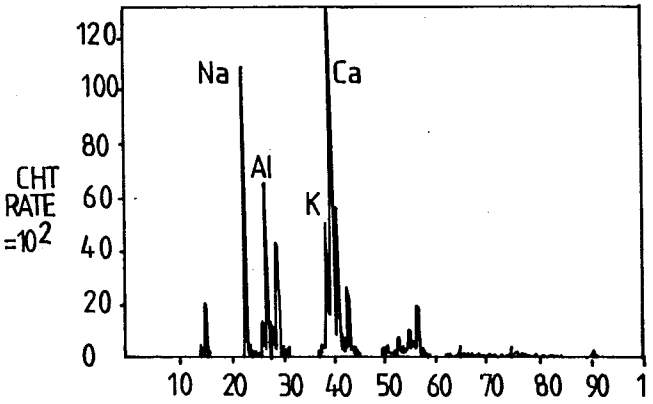
FIG. 8f

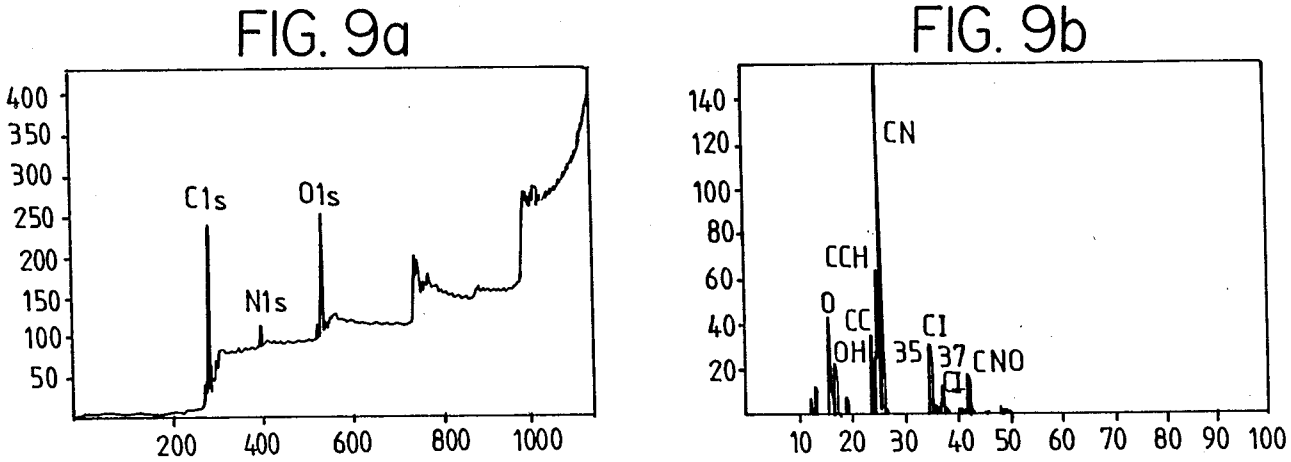
FIG. 9a
FIG. 9b
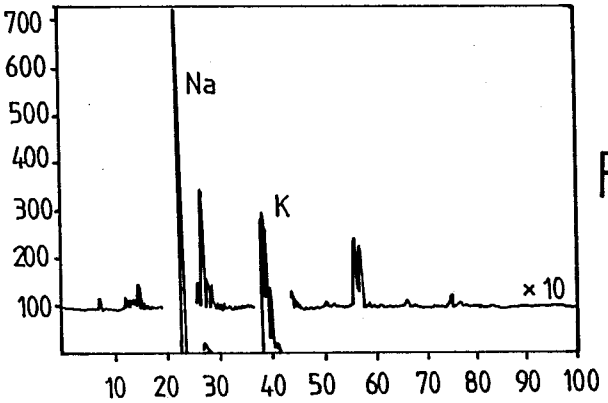
FIG. 9c

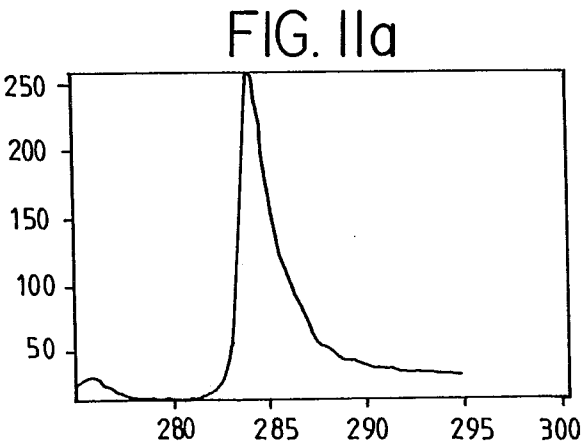
FIG. IIa
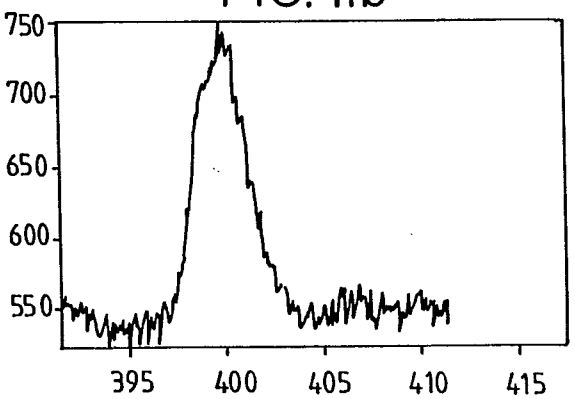
FIG. IIb
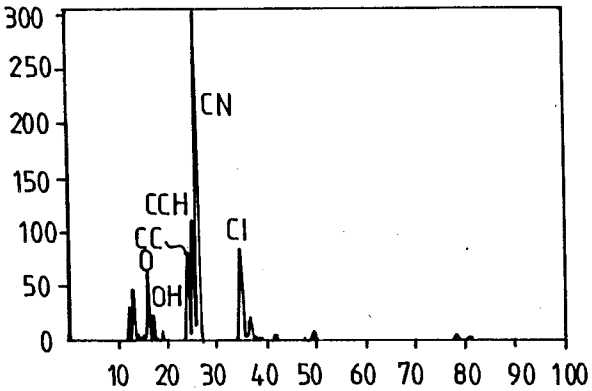
FIG. IIc
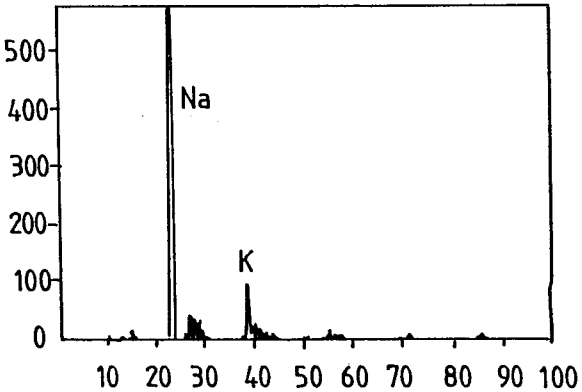
FIG. IId

ELECTROCHEMICAL METHOD OF SURFACE TREATING CARBON; CARBON, IN PARTICULAR CARBON FIBERS, TREATED BY THE METHOD, AND COMPOSITE MATERIAL INCLUDING SUCH FIBERS

The invention relates to an electrochemical method of surface treating carbon materials. It applies in particular to surface treating carbon fibers in order to improve the adherence of the fibers to the resin in a composite material comprising carbon fibers embedded in a matrix of synthetic resin.

BACKGROUND OF THE INVENTION

The mechanical properties of a composite carbon-resin material improve with an increase in the shear stress at which interlaminer decohesion occurs, and consequently with improved adherence between the carbon fibers and the resin. However, very high adherence gives rise to a degree of fragility in the material, i.e. a toughness defect.

Proposals have already been made to improve the adherence of fibers to resin by applying surface treatment to raw carbon fibers as manufactured, either by chemical means or else by electrochemical means. Chemical groups are thus produced on the surface of the fibers to improve fiber adherence to resin, to a large extent by creating chemical bonds between the fiber and the matrix, but also to some extent by increasing the Van der Waals interactions or the bipolar interactions between the two fiber and resin components, where applicable.

Electrochemical treatments of this type are described, for example, in published French patent application No. 2 477 593. They consist essentially in immersing the fibers in an electrolyte solution and in polarizing the fibers positively relative to a cathode. Good adherence is obtained, in particular, by using as electrolytes sulfates and bisulfates of ammonium and sodium which are strong salt electrolytes.

These electrolytes include oxygenous anions and cause oxygenous groups to be grafted onto the carbon fibers. These oxygenous groups improve fiber adherence with synthetic resins, but the method of treatment can sometimes degrade the mechanical properties of the carbon fibers.

The above-mentioned prior application also refers to treatment performed using strong bases and strong acids as electrolytes (sulfuric acid, phosphoric acid, sodium hydroxide). It is then observed either that the hardening of impregnated resin is inhibited, or else that the treated fibers have poor resistance to thermal oxidation.

An examination of the operating conditions of conventional electrochemical treatments shows that:

in general, they use acid, basic, or salt solutions in an aqueous medium; and the potential applied between the anode constituted by the carbon fibers and the cathode is great enough to decompose water causing gaseous oxygen to be evolved, a well-known electrochemical phenomena.

The electrolyte then includes reactive species which attack the carbon of the fibers to form oxygenous surface groups that promote fiber-matrix adhesion. The potential $V_0$ at which water decomposes and evolves oxygen is about +1.7 volts relative to a saturated calomel reference electrode, but it may be less in some electrolytes. In any event, anode treatments performed at more than $V_0$ always give rise, regardless of the electrolytes used, to water decomposition and to the formation of oxygenous groups (of the C=O, COH, COOH, . . . type), and even to a degradation of the surface of the fibers if the working potential $V_t$ is much greater than $V_0$. Only the relative proportions and surface concentrations of the oxygenous groups vary from one method to another, and one can hardly expect an improvement in the toughness of the resulting composite materials since the fiber-matrix interface provided by the oxygenous groups is of essentially the same nature from one treatment to another.

The Applicant's published French patent application No. 2 564 489 describes a method of surface treating carbon fibers in order to graft nitrogenous functions thereon. In this method, the fibers are immersed in an aqueous solution of an amine compound that dissociates water little, so as to avoid lowering $V_0$ too much.

The aim of the invention is to provide an electrochemical method causing nitrogenous groups to be grafted onto the surface of carbon fibers, while avoiding the limitations related to the use of an aqueous solution, in particular with respect to the speed of the electrochemical reaction.

Another aim of the invention is to graft nitrogenous groups onto carbon in a form other than carbon fibers, in particular in divided form, for example for use as a catalyst.

SUMMARY OF THE INVENTION

The present invention provides an electrochemical method of surface treating carbon wherein the carbon is put into contact with a solution of an amine compound in a bipolar solvent by polarizing the carbon positively relative to a cathode, the method being characterized in that the solvent is an organic solvent having a high anode oxidation potential, and that the solution is practically free from water.

Advantageously, the solvent is an aprotic bipolar solvent.

Three conditions must be satisfied for nitrogenous substances to be capable of being grafted onto a carbon surface by electrochemical means.

A first condition is that the surface reactivity of the carbon must be high enough, which is true of microporous carbons, carbons which are graphitizable at low temperature, and surface activated carbons.

Carbons come in two broad categories: graphitizable carbons and nongraphitizable carbons.

Microporous carbons are nongraphitizable carbons having a turbo-stratic structure and characterized by:

low $L_a$ and $L_c$ in X-ray diffraction;

a microporous organization of their microtexture when observed using high resolution transmission electron microscopy; and an isotropic texture when observed using optical microscopy.

$L_a$ and $L_c$ designate the dimensions of the basic texture unit, respectively parallel with and perpendicular to the aromatic layers.

The dimension of the micropores is of the order of a few tens of nanometers; $L_a$ remains small regardless of the heat treatment temperature, since the twist of the layers is not reducible.

So-called "high strength" and "intermediate strenght" carbon fibers, carbon blacks, and some pyrocarbons belong to the category of microporous carbons.

"High strength" carbon fibers have a microtexture constituted by an assembly of basic texture units (UTB) formed by a turbo-stratic stack of two or three small-sized (about 10 angstroms) aromatic layers. The UTBs are connected to each other by chemical bonds of the $sp^3$ type forming a joint with bending and twisting disorientations. A "high strength" fiber is made up of aggregates of UTBs whose average orientation is that of the fiber axis. The surface of such fibers has a high density of $sp^3$ type bonds suitable for being attacked by electrochemical means.

"Intermediate fibers" have UTBs which are slightly larger in size than those of "high strength" fibers; with the surface density of $sp^3$ type bonds remaining high, even though not so high.

The carbon of "high modulus" fibers is analogous to a high $L_a$ nongraphitizable pyrocarbon, however it remains microporous. This type of carbon is not suitable for treatment in accordance with the invention unless it has previously been activated.

"High modulus" fibers have UTBs of a very different size, since they have been subjected to a "graphitizing" step at between 2000° C. and 3000° C. The UTBs are turbo-stratic stacks of several tens of aromatic layers which may reach or even exceed a size of 1000 angstroms, particularly at the surface. Consequently, the density of inter-UTB joints is much lower than for "high strength" fibers, thereby conferring a greatly reduced degree of surface reactivity to "high modulus" fibers since the bonds between the carbon atoms engaged in the aromatic cycles are very stable. The action of a nitrogen plasma on the surface of such fibers increases their reactivity by ejecting carbon atoms from the surface aromatic layers and consequently making treatment in accordance with the invention possible.

Graphitizable carbons are characterized by $L_c$ being greater than $L_a$ at less than about 1500° C., but their $L_a$ increases above 1500° C., and particularly above 2000° C. (as observed using lattice fringes in high resolution electron microscopy) and develops into a three-dimensional periodic structure (graphitization).

When the treatment temperature lies between 600° C. and 1000° C., $L_a$ and $L_c$ are comparable (=2.5 nm). Thereafter, $L_c$ grows up to about 1500° C. Above this temperature, $L_a$ increases and becomes greater than $L_c$.

Carbons capable of being graphitized at low temperature ($\theta \leqq 1500°$ C.) thus have a microtexture which makes them sensitive to the action of an electrochemical treatment. Carbons which are capable of being graphitized at high temperature become sensitive only if their surface is previously activated.

The second condition enabling grafting to take place is that the working potential $V_t$ must be less than the decomposition potential $V_{SOL}$ of the solvent or of the couple solvent+supporting electrolyte.

The organic solvent used in the treatment may be, in particular, acetonitrile, dimethylformamide, or dimethyl sulfoxide. It is advantageous to add a supporting electrolyte to the solution, which supporting electrolyte should also have a high anode oxidation potential $V_{ES}$, and depends on the nature of the organic solvent. Suitable supporting electrolytes include: lithium perchlorate, tetraethylammonium perchlorate, or, for example, tetrafluoroborates, alkaline or quaternary ammonium tetrafluorophosphates.

In general, the working potential $V_t$ is limited by the oxidation potential of the supporting electrolyte, which varies with the solvent used, thereby fixing a potential $V_{SOL}$ for a given couple. The following table lists the observed values of $V_{SOL}$ for various solvents and supporting electrolytes.

| Solvent | Supporting Electrolyte (anions) | $V_{SOL}$ Relative to a Saturated Calomel Electrode | $V_{SOL}$ Relative to a 0.01 M $Ag/Ag^+$ Electrode |
|---|---|---|---|
| Acetonitrile | $ClO_4^-$ | + 2.6 volts | + 2.3 volts |
| | $BF_4^-$, $PF_6^-$ | + 3.5 volts | + 3.2 volts |
| Dimethyl-formamide | $ClO_4^-$ | + 2.0 volts | + 1.7 volts |
| Dimethyl-sulfoxide | $ClO_4^-$ | + 2.1 volts | + 1.8 volts |
| Acetic acid | $CH_3COO^-$ | + 2 volts | + 1.7 volts |
| Dichloro-methane | $ClO_4^-$ | + 1.9 volts | + 1.6 volts |

Finally, the third condition is that the working potential $V_t$ should be greater than the oxido-reduction potential $V_E$ of the amine compound, or if the amine compound has several amine functions, $V_t$ must be greater than the smallest oxidoreduction potential. In order for the electrochemical reactions to take place rapidly, the difference $V_t - V_E$ must be high and $V_t < V_{SOL}$. It is also desirable for $V_t$ not to be too close to $V_{SOL}$ since interfering electrochemical phenomena could then occur such as anode passivation resulting from an accumulation of the products of oxidizing the amines forming a film on the electrode which may perhaps subsist on the surface.

The use of a nonaqueous electrolyte solution makes it easier to reconcile the last two conditions and consequently to perform treatment more rapidly than can be done using an aqueous solution.

The amine compound used in the treatment is advantageously ethylenediamine whose oxido-reduction potential $V_E$ on vitreous carbon is about +1.2 volts relative to a saturated calomel reference electrode in a mixture of acetonitrile and 0.1M tetraethylammonium perchlorate (giving $V_E \simeq +0.9$ volts relative to a 0.01M $Ag/Ag^+$ electrode).

Other suitable amine compounds include amino 6 methyl 2 pyridine, tetramethylbenzidine, or any other compound which at least has an oxido-reduction potential which is less than $V_{SOL}$.

The treatment is performed at a polarization potential which is too small to cause the solvent and the supporting electrolyte to decompose. Good results are obtained by polarizing the fibers to a working potential $V_t$ of about 1.3 volts relative to a 0.01M $Ag/Ag^+$ reference electrode, which value is substantially less than $V_{SOL}$ for the couple acetonitrile+lithium perchlorate, which is about +2.3 volts with this electrode. $V_t = 1.3$ volts is located at the beginning of the ohmic region of the polarization curve.

The invention also provides carbon, in particular in fiber form, treated by the above-defined process, together with a composite material. Carbon treated in accordance with the invention may also be in divided or powder form, providing the carbon also belongs to the categories of microporous carbons, carbons which are graphitizable at low temperature, or carbons having an activated surface.

BRIEF DESCRIPTION OF THE DRAWINGS

Implementations of the invention are described by way of example with reference to the accompanying drawings, in which:

FIGS. 6*a*–6*i* show shows a set of spectra obtained using photoelectron spectroscopy (ESCA=Electron Spectroscopy for Chemical Analysis) and secondary ion mass spectrometry (SIMS) on the surfaces of originally untreated Grafil HT carbon fibers from COURTAULDS which were subsequently subjected to treatment with hexamethylene tetramine in an aqueous medium, wherein FIG. 6*a* is the ESCA spectrum for the untreated fibers, FIG. 6*b* is the negative SIMS spectrum for the untreated fibers, FIG. 6*c* is the positive SIMS spectrum for the untreated fibers, FIG. 6*d* is the ESCA spectrum for the fibers treated for 10 minutes, FIG. 6*e* is the negative SIMS spectrum for the fibers treated for 10 minutes, FIG. 6*f* is the positive SIMS spectrum for the fibers treated for 10 minutes, FIG. 6*g* is the ESCA spectrum for the fibers treated for 60 minutes, FIG. 6*h* is the negative SIMS for the fibers treated for 60 minutes, and FIG. 6*i* is the positive SIMS spectrum for the fibers treated for 60 minutes;

FIG. 7*a*–7*f* show details of the photoelectron peaks obtained on the same hexamethylene tetramine treated fibers (ESCA) wherein FIG. 7*a* is the Cls peak for the untreated fibers, FIG. 7*b* is the Nls peak for the untreated fibers, FIG. 7*c* is the Cls peak for the fibers treated for 10 minutes, FIG. 7*d* is the Nls peak for the fibers treated for 10 minutes, FIG. 7*e* is the Cls peak for the fibers treated for 60 minutes, FIG. 7*f* is the Nls peak for the fibers treated for 60 minutes;

FIG. 8*a*–8*e* show a set of ESCA and SIMS spectra obtained on COURTAULDS' Grafil HT fibers after being subjected to treatment with amino 6 methyl 2 pyridine in an aqueous medium, wherein FIG. 8*a* is the ESCA spectrum, FIG. 8*b* is the negative SIMS spectrum, FIG. 8*c* is the positive SIMS spectrum, FIG. 8*d* is the Cls peak, and FIG. 8*e* is the Nls peak; and FIG. 8*f* shows the ESCA spectrum of fibers treated in methyl 2 pyridine;

FIG. 9*a*–9*e* are ESCA and SIMS spectra obtained on COURTAULDS' Grafil HT fibers after being subjected to treatment with urea in an aqueous medium, wherein FIG. 9*a* is the ESCA spectrum, FIG. 9*b* is the negative SIMS spectrum, FIG. 9*c* is the positive SIMS spectrum, FIG. 9*d* is the Cls peak, and FIG. 9*e* is the Nls peak;

FIG. 10*a*–10*e* are is a set of ESCA and SIMS spectra obtained on COURTAULDS' Grafil HT fibers after being subjected to treatment with ethylenediamine in acetonitrile having lithium perchlorate added thereto, wherein FIG. 10*a* is the ESCA spectrum, FIG. 10*b* is the negative SIMS spectrum, FIG. 10*c* is the positive SIMS spectrum, FIG. 10*d* is the Cls peak, and FIG. 10*e* is the Nls peak;

FIG. 11*a*–11*d* are ESCA and SIMS spectra obtained for the same fibers after being subjected to treatment with amino 6 methyl 2 pyridine in acetonitrile without a supporting electrolyte, wherein FIG. 11*a* is the Cls peak, FIG. 11*b* is the Nls peak, FIG. 11*c* is the negative SIMS spectrum, and FIG. 11*d* is the positive SIMS spectrum;

FIG. 12*a*–12*h* are ESCA and SIMS spectra obtained for COURTAULDS' Grafil HT fibers after being subjected to treatment with ethylenediamine in dimethylformamide having lithium perchlorate added thereto, wherein FIG. 12*a* is the Cls peak after treatment at $V_t = +1.45$ volts/ECS, FIG. 12*b* is the corresponding Nls peak, FIG. 12*c* is the corresponding negative SIMS spectrum, and FIG. 12*d* is the positive SIMS spectrum; FIG. 12*e* is the Cls peak after treatment at $V_t = +1.6$ volts/ECS, FIG. 12*f* is the corresponding Nls peak, FIG. 12*g* is the corresponding negative SIMS spectrum, and FIG. 12*h* is the corresponding positive SIMS spectrum;

FIG. 13*a*–13*c* show the variation in the fiber-matrix decohesion stress $\tau_d$ for three types of treatment in an aqueous medium as mentioned above and as a function of duration, wherein FIG. 13*a* shows the variation in cohesion stress for fibers treated in hexamethylene tetramine, FIG. 13*b* shows the variation in cohesion stress for fibers treated in amino 6 methyl 2 pyridine, and FIG. 13*c* shows the variation in cohesion stress of the fibers treated in urea; the resin used was Araldite LY 556 and the hardener was HT 972, both from CIBA GEIGY;

FIG. 14*a*–14*b* show the change in the fiber-matrix decohesion stress $\tau_d$ for treatments using ethylenediamine in acetonitrile with lithium perchlorate added thereto, wherein FIG. 14*a* shows the change in decohesion stress for CIBA GEIGY's Araldite LY 556 and FIG. 14*b* shows the change in decohesion stress for NARMCO 5208; and FIG. 15*a*–15*d* are ESCA spectra for showing that epichlorohydrin fixes on fibers treated with hexamethylene tetramine and does not fix on the same fibers when not so treated, wherein FIG. 15*a* is the Cls peak for the untreated fibers, FIG. 15*b* is the Cls peak after treatment for one hour, FIG. 15*c* is the Cls peak for the untreated fibers after being subjected to epichlorhydrin, and FIG. 15*d* is the Cls peak of fibers treated with hexamethylene tetramine and with epichlorhydrin.

MORE DETAILED DESCRIPTION

Figure 1:
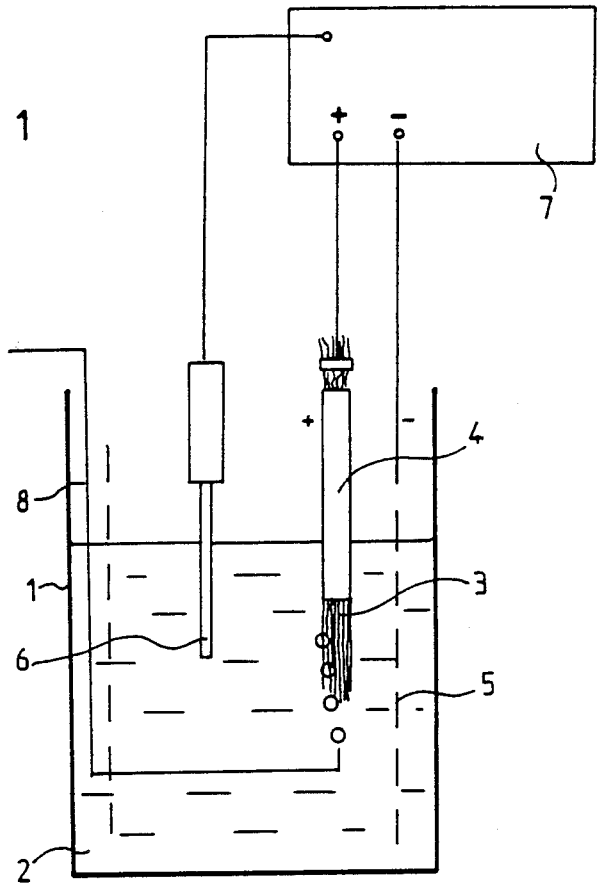
FIG. 1 is a diagram of a laboratory setup for performing the method.

In the experimental setup shown diagrammatically in FIG. 1, a tank 1 contains an electrolyte solution 2 having a bundle of carbon fiber monofilaments 3 plunged therein to form an anode and surrounded by an insulating support 4. The anode, together with a platinum cathode 5 and a reference electrode 6 are also dipped into the solution 2 and are connected to a potentiostat 7 for maintaining a potential at a predetermined value between the anode and the reference electrode. The predetermined value is selected so as to avoid oxygen being evolved by electrolysis in an aqueous medium or to avoid decomposition of the mixture comprising the solvent and the supporting electrolyte ($LiClO_4$) in a nonaqueous medium. The reference electrode 6 is a saturated calomel electrode for treatment in an aqueous medium or a 0.01M $Ag/Ag^+$ system in acetonitrile for treatment in a nonaqueous medium.

Argon is bubbled through the bath via a tube 8 which opens out beneath the fibers 3. This prevents oxygen from being dissolved in the bath.

The electrolyte bath 2 is either an aqueous solution of an amine compound, or else a solution of an amine compound and a supporting electrolyte in a bipolar organic solvent. The electrochemical reactions take place at the interface between the solution and the fibers and have the effect of nitrogen grafting nitrogenous groups or molecules of the amine compound on the surface of the fibers.

Figure 2:
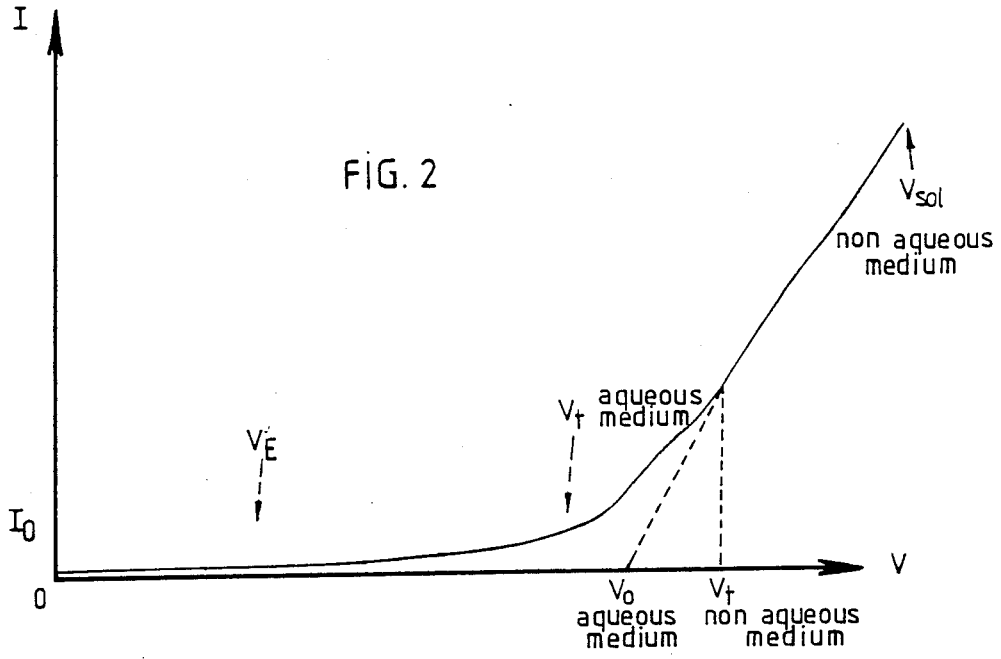
FIG. 2 is a characteristic curve showing the change in current as a function of the potential applied to the fibers.

The curve in FIG. 2 shows variation in current I passing through the anode as a function of its potential V relative to the reference electrode. When the potential is small enough, the current takes a value $I_O$ which is substantially independent of potential. At higher values, the current increases rapidly along a curvilinear portion which runs into a linear portion which is characteristic of ohmic conditions. The working potential $V_t$ is selected to be as high as possible but less than a value $V_O$ at which oxygen beings to be evolved in an aqueous medium (Examples 1, 2, and 3) or to be less than the ohmic region in a nonaqueous medium (Example 4). In Examples 1 to 3 below, $V_O$ is generally about +1.7 volts (relative to a saturated calomel electrode) providing the compound dissociates poorly in water, and the working potential may be selected to be close to +1.5 volts. The working potential $V_t$ is about +1.3 volts (relative to the $Ag/Ag^+$ reference electrode) in a nonaqueous medium (Example 4), said value being close to the beginning of the ohmic region. There is no advantage in selecting a smaller value for $V_t$ since that would slow down the electrochemical process.

The organic solvent (for example acetonitrile) must be free from water and must initially be dehydrated if it contains any. Another characteristic is that it must be bipolar in nature in order to dissolve the supporting electrolyte whose nature is unimportant insofar as it is not involved in the electrochemical processes (i.e. so long as its decomposition potential is substantially higher than the working potential $V_t$). In addition, if the solvent is aprotic, it facilitates removing a proton from a cation radical. The choice of bipolar solvent lies solely on the consideration that its decomposition potential should also be considerably greater than $V_t$.

The curve in FIG. 2 does not, in general, show the oxido-reduction peak of the amine compound since the geometry of the electric field lines is complex in the vicinity of a multifilament electrode. The potential $V_E$ is a magnitude which, at the time of writing, has been determined for a small number only of amine compounds, and even then it depends on the solvent and the supporting electrolyte. It has been established that $V_E \simeq +0.9$ volts for ethylenediamine in acetonitrile+tetraethylammonium perchlorate+an $Ag/Ag^+$ electrode, which is less than the working potential of Example 4 ($V_t = 1.3$ volts). Thus, the conditions $V_E < V_t$ and $V_t < V_{SOL}$ are fully satisfied.

Figure 3:
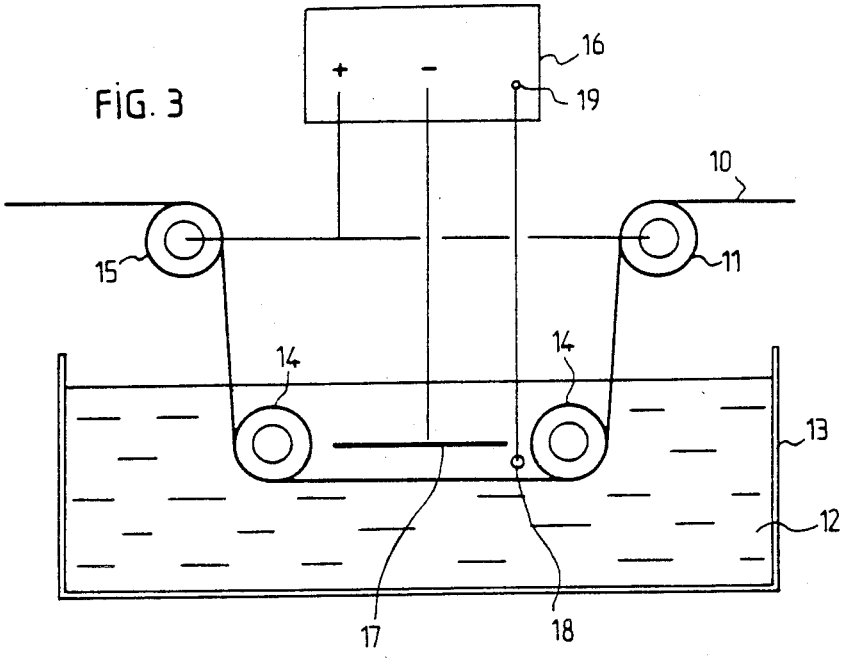
FIG. 3 is a diagram of an industrial installation for performing the method with carbon fibers.

An installation for treating fibers continuously is shown in FIG. 3. A continuous wick or thread 10 made up from a multitude of carbon fibers runs from a reel (not shown), passes over a roll 11 situated above an electrolyte bath 12 contained in a tank 13, and then in succession over two rolls 14 immersed in the bath 12, and finally over a roll 15 situated above the bath prior to being wound onto a take-up reel (not shown). The roll 15 (and optionally the other rolls) is rotated by means not shown in order to cause the thread 10 to advance continuously. The rolls 11 and 15 are connected to a positive output terminal of a potentiostat 16 whose negative terminal is connected to a stainless steel cathode 17 immersed in the solution 12 so as to polarize the thread 10 positively relative to the cathode. A calomel reference electrode 18 is connected to a control terminal 19 of the potentiostat 16, thereby enabling the potential of the anode to be fixed to a desired value relative to the reference electrode. This installation serves to perform the same type of treatment as the setup shown in FIG. 1, but on a continuous basis.

Figure 4:
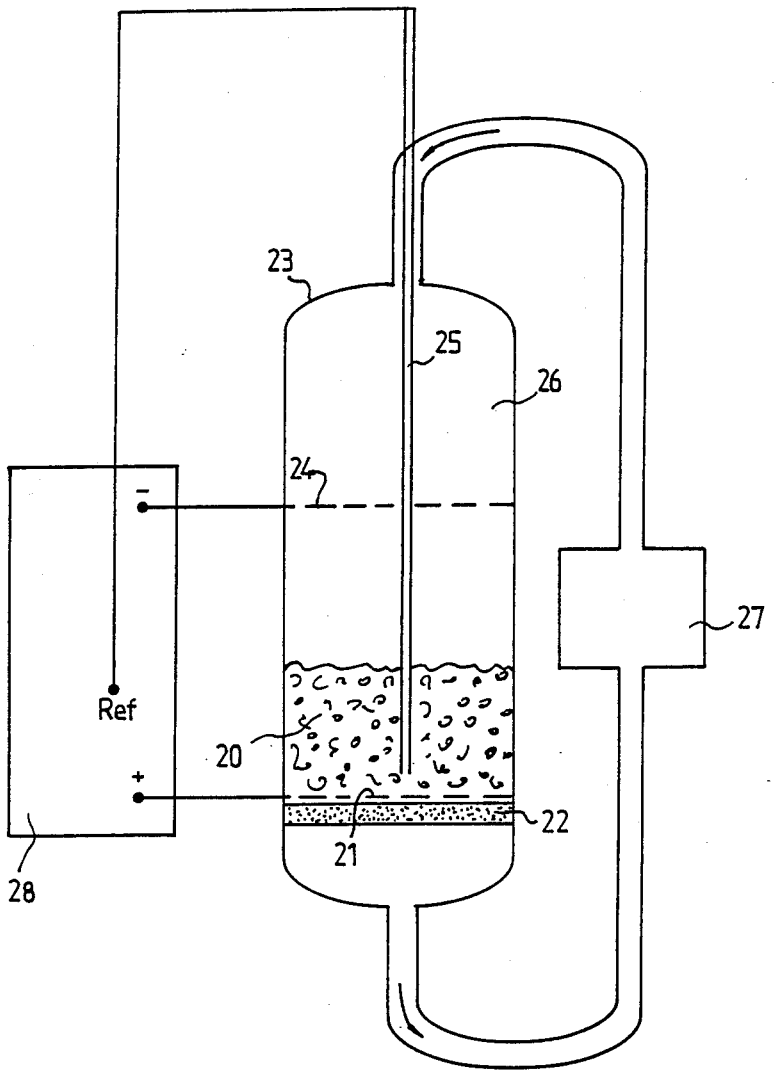
FIG. 4 is a diagram of an industrial installation for performing the method with divided carbon.

An installation for treating divided carbon is shown diagrammatically in FIG. 4. A bed of divided carbon 20 is retained by a fine platinum mesh 21 acting as an anode, and itself resting on a porous disk 22 which closes a vertical cylindrical column 23 made of glass. A second platinum mesh 24 disposed above the bed of carbon 20 constitutes the cathode. The reference electrode 25 is plunged into the carbon bed 20. The enclosure 23 is filled with electrolyte 26 and the electrolyte is caused to flow in the cathode-to-anode direction by a pump 27 (with pump components that come into contact with the electrolyte being chemically inert). The anode 21, the cathode 24, and the reference electrode 25 are connected to a potentiostat device 28. This installation serves to perform the same type of treatment as the FIG. 1 setup but with divided carbon.

The method used for determining the adherence of the carbon fibers to a resin is now described.

One end of an isolated fragment of fiber is inserted in the moving jaw of a traction machine, and it is bonded thereto by a drop of solder, while the other end is embedded in resin over a distance which is short enough to ensure that the force required for pulling the fiber out from the resin is less than the breaking force of the fiber.

The extraction force $F_d$ is measured by means of the traction machine. The perimeter p of the filament section and the length l thereof implanted in the resin are determined by means of a scanning electron microscope of calibrated magnification. Greszozuk has established a theory for testing extraction. He shows that the shear stress $\tau$ between the fiber and the matrix is at a maximum at the point where the filament enters the matrix and that the stress falls off with increasing distance from said point. At the moment of decohesion, $\tau$ reaches $\tau_d$ which is the fiber-matrix decohesion stress. $\tau_d$ is given by the formula:

$$\tau d = \frac{f_d \alpha}{p} \coth$$

where $\alpha$ is a coefficient that takes account of the geometry of the filament being received in the matrix, Young's modulus of the fiber, and the shear modulus of the resin. Experiment gives access to the average decohesion stress $\overline{\tau}$ which is given by the formula:

$$\overline{\tau} = F_d / p1$$

thus:

$$\overline{\tau} = (t_d \tan h\ \alpha 1)/\alpha 1$$

Experimental values therefore need correcting for the effect of the length of the fiber received in the resin. By varying this length from one filament to another, a curve $\overline{\tau} = f(1)$ is obtained which is fitted to the above formula by a least squares method. $\tau_d$, i.e. the interface decohesion stress, is thus determined, thereby characterizing the adherence of the fiber to the resin and the aptitude of the fiber-resin interface for withstanding shear. The points plotted in FIGS. 13 and 14 each come from a set of measurements of $\overline{\tau} = f(1)$, from which $\tau_d$ is deduced together with an estimate of the error on $\tau_d$ for a confidence interval of 68%.

Examples 1 to 3 below are taken from the above-mentioned French patent No. 2 564 489, but the values of $\tau_d$ given therein have been corrected for the effect of the length of fiber that is received in the resin as mentioned above, whereas the results given in the above patent did not take account of this correction. The effect of the correction is to increase the values of $\tau_d$ a little so that they are now closer to reality, thereby making it possible to obtain a more accurate comparison between the corresponding results and results obtained by the present invention which are given in Example 4. All of the values of $t_d$ given below are corrected values, and the error on $\tau_d$ is estimated with a confidence interval of 68%.

EXAMPLE 1

Using the FIG. 1 setup, initially untreated HT type carbon fibers produced by COURTAULDS LIMITED were treated in an electrolyte bath comprising an aqueous solution of hexamethylene tetramine (tertiary amine) at 50 grams (g) per liter, with a pH of 8.62 and with the fibers being at a potential of +1.45 volts relative to the saturated calomel reference electrode. Treatment took place at temperature of 20° C.

Test pieces for measuring the interface decohesion stress $t_d$ were prepared using CIBA GEIGY's Araldite LY 556 resin (bisphenol A diglycidylether) with HT 972 hardener (4–4′ diaminodiphenylmethane) with hardening taking place over 16 hours at 60° C. followed by two hours at 140° C.

Figure 13A:
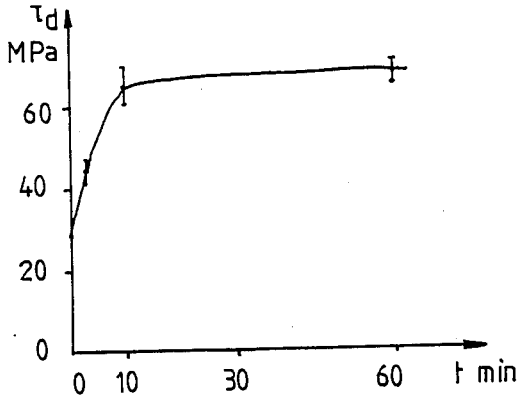

FIG. 13*a* corresponds to Table I and shows variation in $t_d$ as a function of treatment time. It may be observed that the treatment considerably increases $\tau_d$, and that $\tau_d$ is practically stable from t=10 minutes onwards.

TABLE I

| Treatment Time in Minutes | Decohesion Stress $\tau_d$ in MPa |
|---|---|
| Untreated fibers | 28.1 ± 2.5 |
| 3 | 44.3 ± 3.3 |
| 10 | 65.5 ± 4.7 |
| 60 | 68.3 ± 2.9 |

Figure 6D:
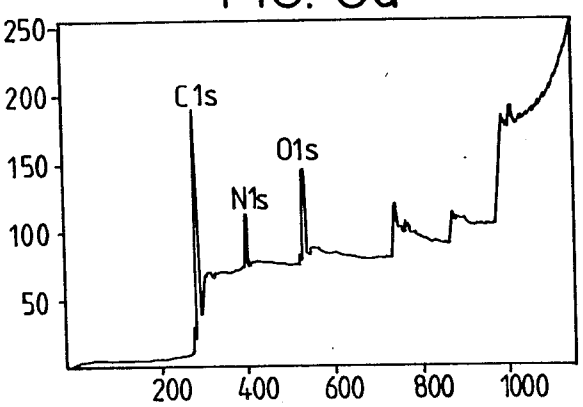
Figure 6E:
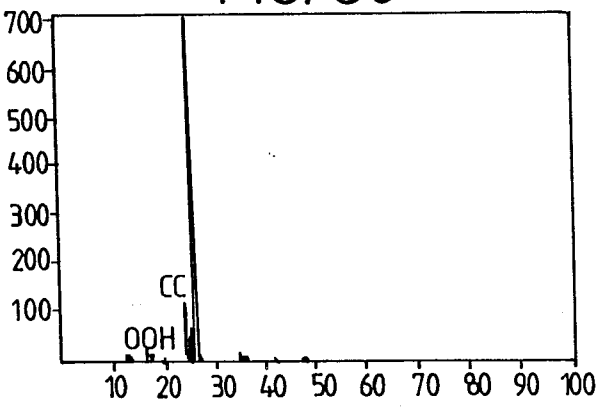

FIG. 6 shows the ESCA and SIMS spectra obtained from COURTAULDS' HT fibers which are not treated (a, b, c) then from fibers which have been treated for 10 minutes (d, e, f) and from fibers which have been treated for 60 minutes (g, h, i). The (ESCA) Cls and Nls peaks are shown in detail in FIG. 7.

The ESCA analysis (FIGS. 6*a*, 6*d*, and 6*g*) serves firstly to determine the nature of the elements present in the outer layer of the fibers, which layer is about 5 nm (50 angstroms) thick, and secondly to obtain information on the state of the chemical bonding of these elements.

A SIMS spectrum shows peaks that correspond to various species of ion torn from the surface by the primary argon ion beam, with the composition thereof coming from the elements present at the surface of the fibers down to a thickness of about 0.5 nm (5 angstroms). With a negative SIMS (FIGS. 6*b*, 6*e*, and 6*h*), the peak at mass 24 ($CC^-$ secondary ions) is characteristic of the carbon substrate and serves as a reference. The peaks at masses 25 and 26 correspond to $CCH^-$ and $CCH_2^-$ ions for the nontreated fiber which contains very little nitrogen. With treated fibers, the peak at mass 26 contains $CCH_2^-$ ions and $CN^-$ ions coming from the nitrogenous surface groups. A convenient way of understanding the degree to which the fiber surface is enriched in nitrogen is to use the ratio R(N) defined as follows:

$$R(N) = \frac{\text{height of the peak at mass 26}}{\text{height of the peak at mass 24}}$$

For oxygen, R(O) is defined in a similar manner using the peaks at masses 16 and 17 ($O^-$ and $OH^-$).

Table II shows the analyses performed.

TABLE II

| Treatment time in minutes | ESCA Average Composition of the surface layer (5 nm) % C | % N | % O | SIMS R(N) | R(O) |
|---|---|---|---|---|---|
| Untreated fibers | 96 | 0.5 | 3.2 | <0.25 | 0.44 |
| 0 | 81 | 9 | 9 | 5.9 | 0.25 |
| 60 | 71 | 11.7 | 15.7 | 5.8 | 1.44 |

Although the treatments add at least as much oxygen as they do nitrogen, an examination of these data show that the nitrogen is located actually on the surface of the fibers whereas the oxygen is distributed beneath the surface.

Figure 6F:
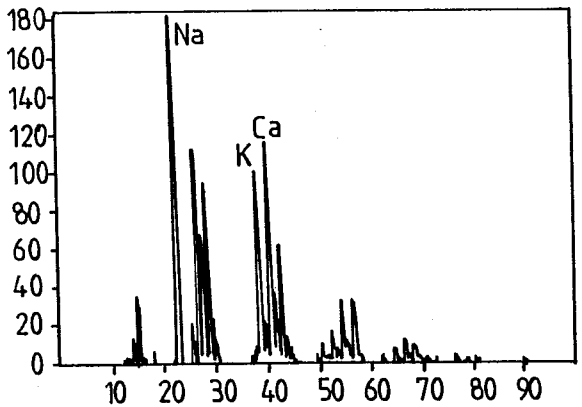
Figure 7B:
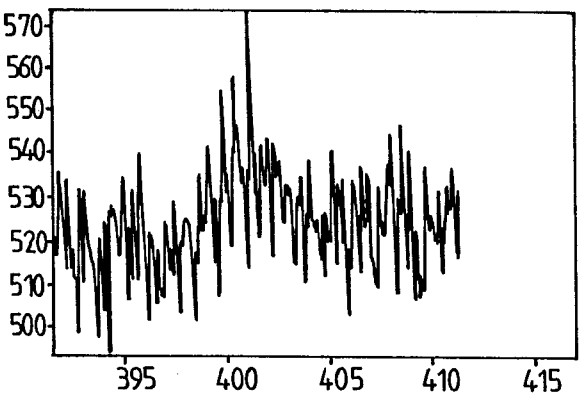
Figure 7A:
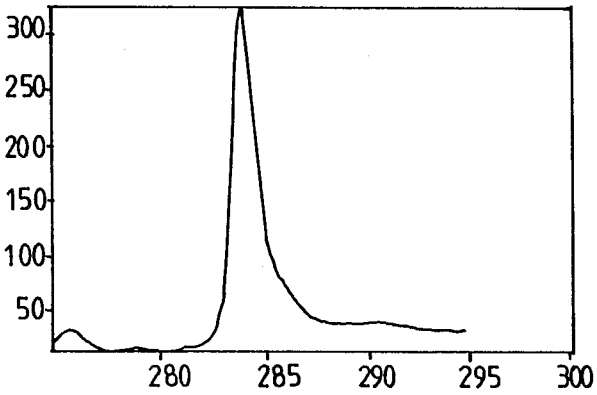
Figure 7C:
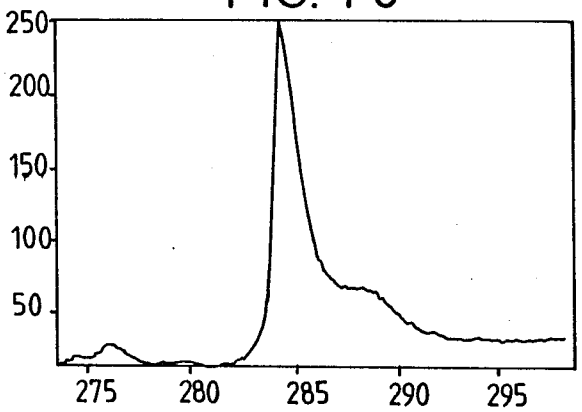
Figure 7E:
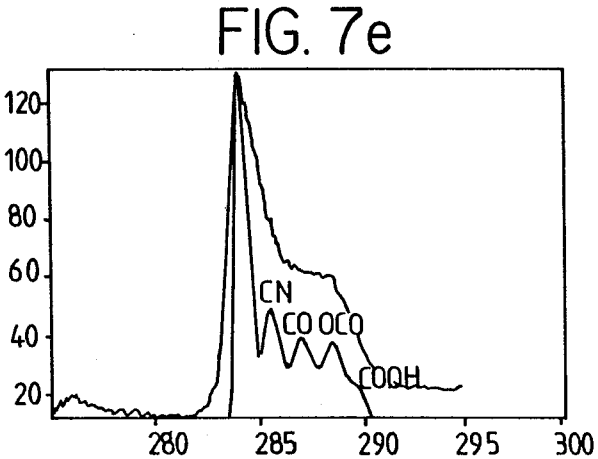
Figure 7D:
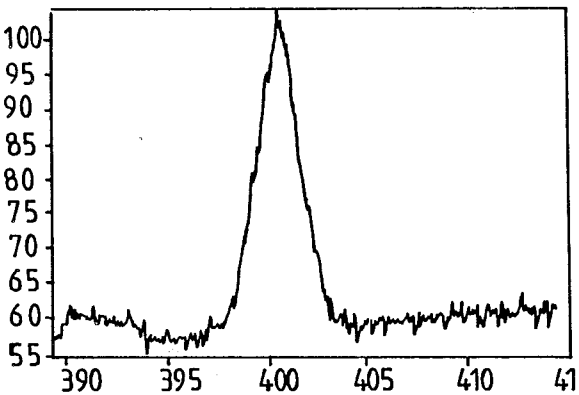
Figure 7F:
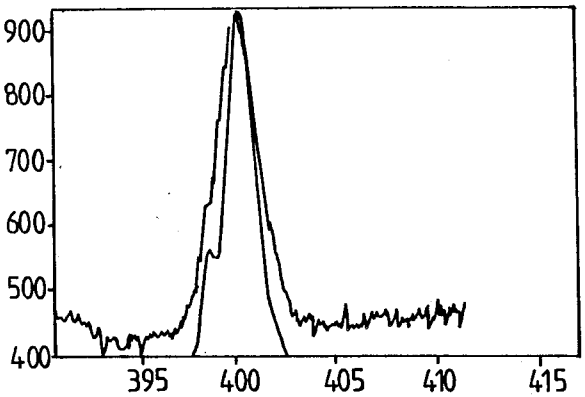

FIGS. 6*c*, 6*f*, and 6*i* show the positive SIMS spectra, i.e. the positive secondary ion spectra. FIG. 6*f* (t=10 minutes) shows ranges of peaks spaced apart at a period of 15 mass units. These ranges are absent from the spectra of nontreated fibers and from the spectra of fibers treated for 60 minutes (FIGS. 6*c* and 6*i*). These ranges are characteristic of a surface molecule including $CH_2$ groups being fragmented by the primary beam. This means that after 10 minutes of treatment, the hexamethylene tetramine molecule or the greater portion thereof is present on the surface, whereas after 60 minutes of treatment only $—NH_2$ and =NH groups remain on the surface of the fibers. The hexamethylene tetramine molecule is progressively degraded by electrochemical reactions but without reducing $\tau_d$. Since the $—NH_2$ and =NH groups are smaller than the hexamethylene tetramine molecule, it is normal that R(O) is greater at t=60 minutes than at t=10 minutes.

FIG. 7 shows the corresponding Cls and Nls photoelectron peaks. At t=10 minutes and t=60 minutes (FIGS. 7*c* and 7*e* respectively) the Cls peaks have a shoulder when compared with the Cls peak for nontreated fibers (FIG. 7*a*), thereby showing that the carbon is bonded in part to elements that are more electronegative than it is, and in particular to nitrogen. The Nls peaks (FIGS. 7*b*, 7*d*, and 7*f* respectively at 0 minutes, 10 minutes, and 60 minutes) are asymmetrical. Their shapes and their binding energy positions demonstrate that $—NH_2$ and =NH groups are present and are covalently bonded to the carbon substrate.

EXAMPLE 2

Treatments were performed using amino 6 methyl 2 pyridine (primary amine) as the electrolyte. The bath was an aqueous solution with 25 g per liter of amino 6 methyl 2 pyridine at pH≃10.06 and the COURTAULDS' HT fibers were at a potential of +1.5 volts relative to a saturated calomel reference electrode. The treatment temperature was 20° C. $\tau_d$ was measured by the procedure used in Example 1.

Figure 13B:
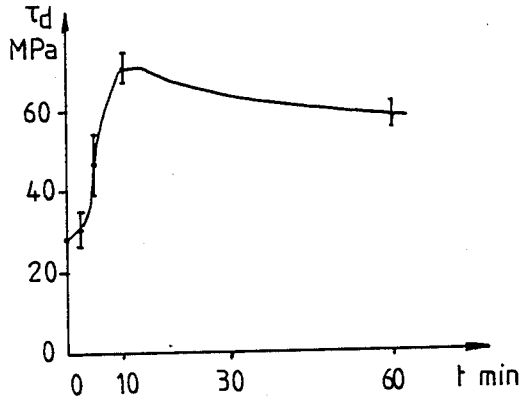

FIG. 13*b* correspnds to Table III and shows how $\tau_d$ varies as a function of treatment time. This curve has a maximum at around 10 minutes of treatment and the value of $\tau_d$ obtained at this time is quite comparable to that obtained in Example 1 for the same length of time.

TABLE III

| Treatment Time in Minutes | Decohesion Stress $\tau_d$ in MPa |
|---|---|
| Untreated fibers | 28.1 ± 2.5 |
| 2.5 | 44.3 ± 3.3 |
| 5 | 46.7 ± 7.5 |
| 10 | 70.3 ± 3.4 |
| 60 | 59.6 ± 3.3 |

FIG. 8 shows a set of ESCA and SIMS spectra for one hour of treatment. ESCA analysis (FIG. 8*a*) gives:

C: 72%

N: 16.7% (analyzed over a thickness of 5 nm)

O: 10.5%

Using SIMS analysis, the surface enrichment ratios were:

R(N)=4 (cf FIG. 8*b* for negative SIMS)

R(O)=0.13.

The Cls and Nls peaks (FIGS. 8*d* and 8*e*) show that nitrogen is bound covalently to the carbon in a manner analogous to Example 1. It is localized on the surface of the fibers: R(N)>>R(O). The shift in the Nls peak towards lower binding energies compared with the peak marked Hl (FIG. 8*e*) relating to treatment with hexamethylene tetramine (t=60 minutes) comes from the fact that ESCA analysis detects nitrogen engaged in the pyridine cycle of the amino 6 methyl 2 pyridine molecule. Its presence on the surface is attested by the detection of ranges of peaks at a spacing of 14 mass units under positive SIMS measurement (FIG. 8*c*). Entire amino 6 methyl 2 pyridine molecules are thus still grafted even after 60 minutes of treatment. This grafting takes place by means of the nitrogen in the amine function. The same treatment performed with methyl 2 pyridine, a molecule which does not include the $NH_2$ group of amino 6 methyl 2 pyridine, shows after analysis that only 1.6% of nitrogen is fixed (ESCA), that R(O) is small at 1.4, and that the ranges of peaks observed with amino 6 methyl 2 pyridine become highly attenuated (FIG. 8*f*). The nitrogen in the pyridine cycle is involved very little in the electrochemical reaction The maximum of the curve $\tau_d=f(t)$ (FIG. 13*b*) may be related to partial deprotonizing of the nitrogen by which the amino 6 methyl 2 pyridine molecule is grafted onto the carbon. A small proportion of the molecules are probably deactivated with respect to fiber-resin adhesion.

EXAMPLE 3

Treatments were performed using urea as the electrolyte. This substance is an aminoamide including two amine groups.

COURTAULDS HT carbon fibers were treated using the FIG. 1 setup, with the electrolyte bath being an aqueous solution of urea at 50 g per liter, pH=7.42, and with the fibers at a potential of +1.5 volts relative to the saturated calomel reference electrode. The treatment temperature was 20° C. $\tau_d$ was measured using the procedure of Example 1.

Figure 13C:
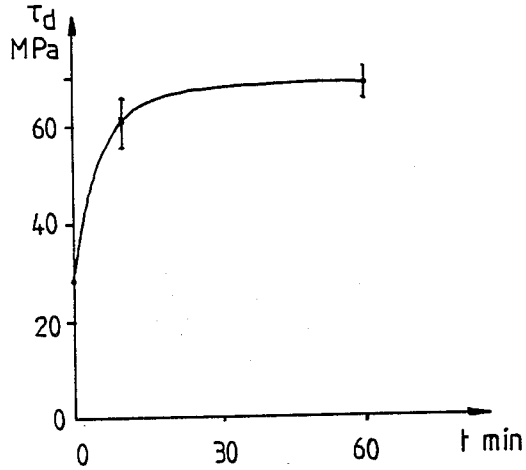

FIG. 13*c* corresponds to Table IV and shows how $\tau_d$ varies as a function of treatment duration.

TABLE IV

| Treatment Time in Minutes | Decohesion Stress $\tau_d$ in MPa |
|---|---|
| Untreated fibers | 28.1 ± 2.5 |

TABLE IV-continued

| Treatment Time in Minutes | Decohesion Stress $\tau_d$ in MPa |
|---|---|
| 10 | 61.2 ± 5.3 |
| 60 | 69.3 ± 3.3 |

A highly significant increase of $t_d$ was also obtained in this example.

Figure 9E:
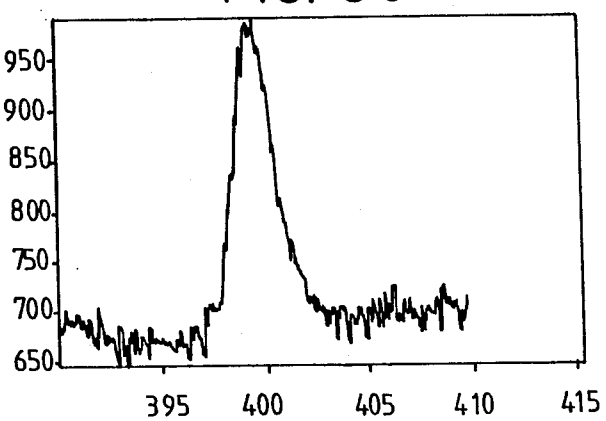

For treatment over one hour (cf FIG. 9*a*) ESCA gives:

C: 76.3%

N: 5.9%

O: 17.8% and negative SIMS (cf FIG. 9*b*) gives:

R(N)=4.3

R(O)=1.8.

Figure 9D:
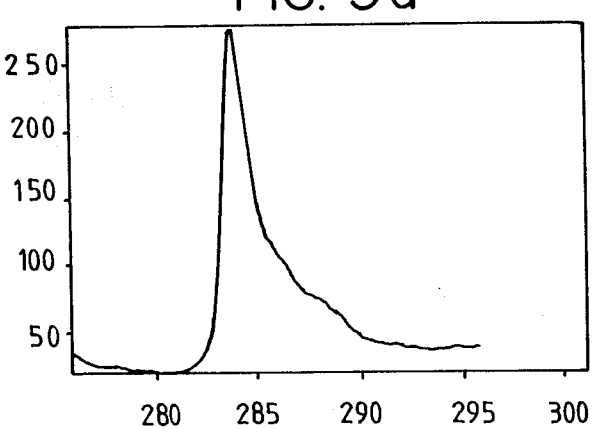

Although the concentration of oxygen is considerably greater than that of nitrogen, there is still a highly favorable degree of surface enrichment with nitrogen. The Cls peak (FIG. 9*d*) has a shoulder similar to those mentioned in Examples 1 and 2. The Nls peak (FIG. 9*e*) is offset towards low binding energies compared with the Nls peak of hexamethylene tetramine (Example 1). Using negative SIMS (see FIG. 9*b*), a peak is observed at mass 42 corresponding to $CNO^-$ ions. Using positive SIMS (FIG. 9*c*) peaks are observed at masses 56 and 57 which may correspond to $CON_2^+$ and $CON_2H^+$ ions. It is therefore highly likely that the urea molecule is being grafted.

The treatments of following Examples 4, 5, and 6 were performed in a nonaqueous medium.

EXAMPLE 4

The electrolyte was ethylenediamine (primary amine including two amine functions) in solution at 12 g per liter in dehydrated acetonitrile. 21 g lithium perchlorate per liter of solution were added as a supporting electrolyte. The potential of the COURTAULDS HT fibers was +1.3 volts relative to a 0.01M $Ag/Ag^+$ reference electrode containing acetonitrile. The temperature was 20° C., and the experimental treatment setup was that shown in FIG. 1. $\tau_d$ was measured by the procedure used in Example 1.

Figure 14A:
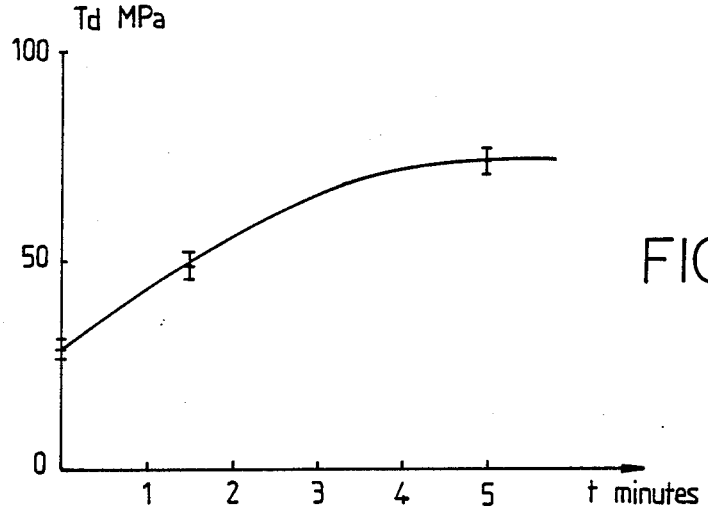

FIG. 14*a* shows the variation in $\tau_d$ as a function of treatment duration for a fiber coated with the following resin: Araldite LY 556+HT 972.

Figure 14B:
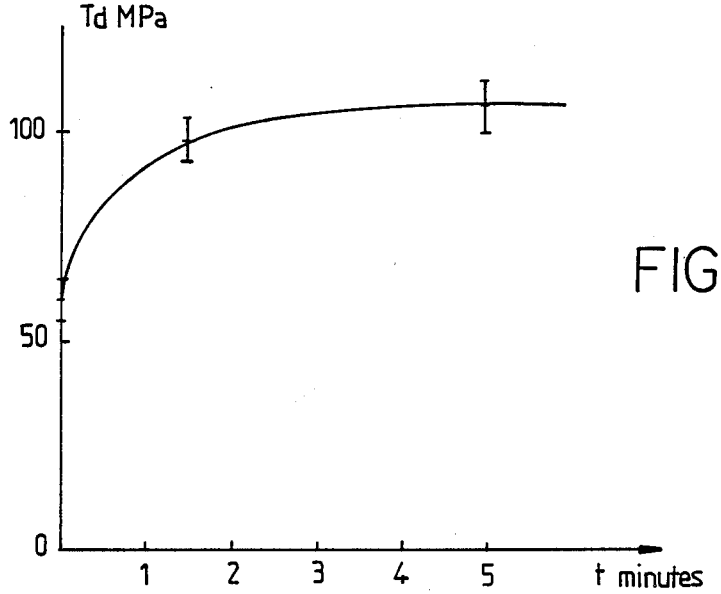

FIG. 14*b* shows the result that was obtained using NARMCO 5208 resin which is sold by the firm NARMCO and which is mainly constituted by tetraglycidylmethylenedianiline and diaminodiphenylsulfone acting as a hardener.

The data is summaried in Table V.

TABLE V

| Treatment time in Minutes | Decohesion Stress $\tau_d$ in MPa | |
|---|---|---|
| | LY 556 Resin | NARMCO 5208 Resin |
| Untreated fibers | 28.1 ± 2.5 | 60.9 ± 5.1 |
| 1.5 | 48.8 ± 3.3 | 97.7 ± 5.3 |
| 5 | 73.4 ± 3 | 105.5 ± 6.5 |

Surface analyses for treatment having a duration of 5 minutes provide:

using ESCA:

C: 66%

Figure 10A:
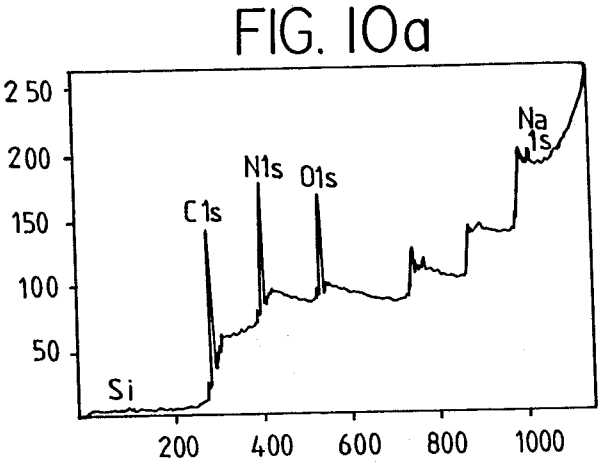

N: 22% (see FIG. 10*a*)

Figure 10B:
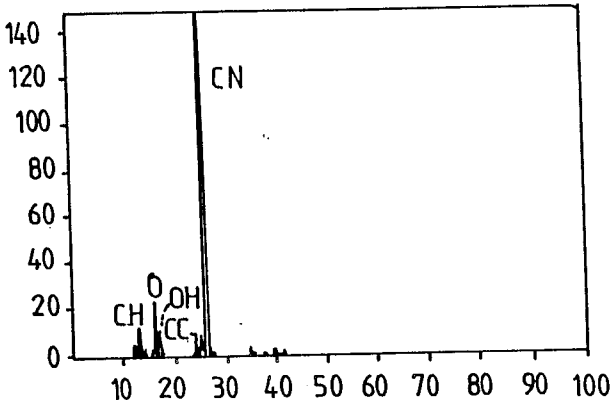

O: 11% using SIMS:

R(N)=22 (see FIG. 10b)
R(O)=2.7.

Figure 10C:
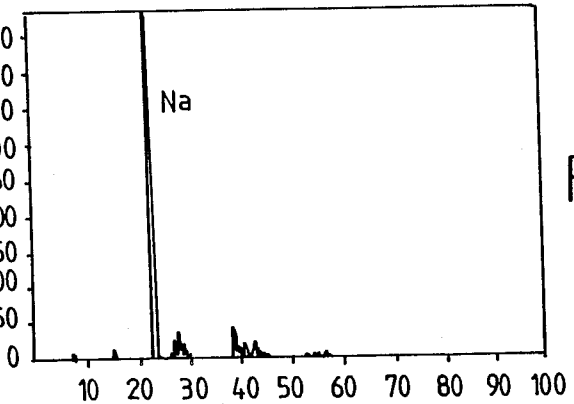
Figure 10E:
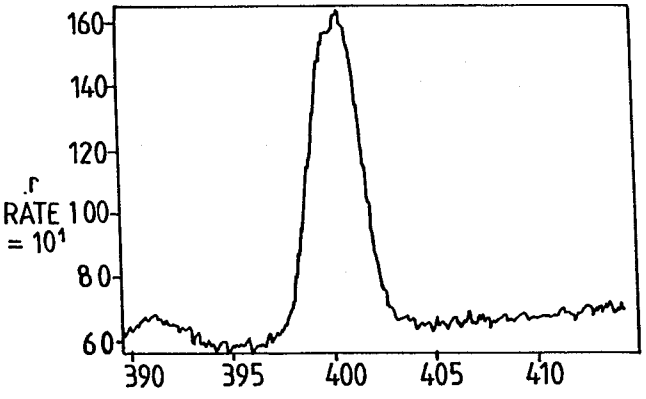
Figure 10D:
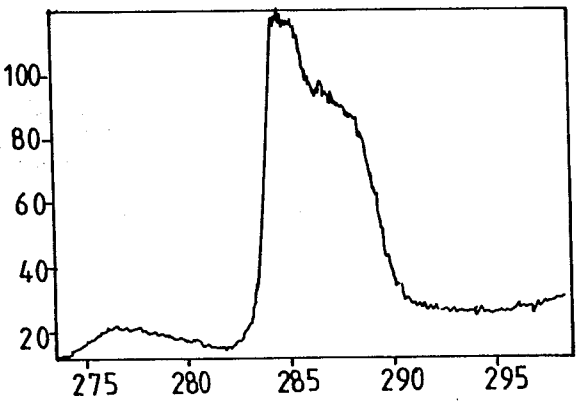

The Cls peak (FIG. 10d) shows a very large shoulder indicating that a large portion of the surface carbon is bound covalently to atoms which are more electronegative than carbon, and in particular to nitrogen, since R(N) and the concentration of nitrogen are very high. Here again, the nitrogen is localized at the surface: R(N)>>R(O). Oxygen—which may come from traces of water in the solution—is situated beneath the surface. The asymmetry of the Nls peak (FIG. 10e) indicates that $—NH_2$ and =NH functions are present at the surface. In spite of the size of the $Na^+$ peak, positive SIMS (see FIG. 10c) shows the presence of two small ranges of peaks for masses around 28 and 42. It is very probable that ethylenediamine molecules are being grafted.

These results call for the following comments:

this treatment is most favorable to grafting nitrogenous functions much more quickly and much more densely than the treatments in aqueous mediums are shown in Examples 1, 2, and 3;

nevertheless the decohesion stress $\tau_d$ is not substantially any greater than that which is obtained in an aqueous medium using CIBA GEIGY's LY 556 resin.

One should therefore consider that the interface made with this resin cannot support shear stress greater than about 70 MPa. In contrast, when using NARMCO 5208 resin, 105.5 MPa were reached (see Table V), with the treatment reaching maximum effectiveness after about 2.5 minutes (see FIG. 14b).

It should be observed that $\tau_d$ for NARMCO 5208 resin is 60.9 MPa for untreated fibers as compared with 28.1 MPa with CIBA GEIGY's LY 556 resin. This may be explained by considering that NARMCO 5208 resin is more highly reactive than CIBA GEIGY LY 556 resin with respect to the bare surface of untreated fibers, and that direct fiber-matrix bonds may be established without any surface groups. Similarly, NARMCO 5208 resin reacts more easily with grafted surface groups since maximum adhesion is obtained in practice at around 2.5 minutes.

Measurements of $\tau_d$ performed on a "high strength" fiber commercially available under the name TORAY T300 90A gave a value of $\tau_d=61\pm4$ MPa with CIBA GEIGY's LY 556 resin, which value is less than that obtained using an aqueous medium (Examples 1, 2, and 3) or a nonaqueous medium (Example 4), thereby demonstrating the effectiveness of treatments using amine-containing electrolytes.

The effect of the working voltage on the nonaqueous medium is illustrated by the following results. Other things being equal, with $V_t=+1$ volts relative to the $Ag/Ag^+$ reference electrode, and with t=5 minutes:

$\tau_d=67.3\pm2.9$ MPa

C: 70.7%
N: 17.6%
O: 9.4%
R(N)=15.2
R(O)=1.7

It should be observed that the decohesion stress is little affected by reducing $V_t$. In contrast, the quantity of surface nitrogen is reduced by about one-fourth.

EXAMPLE 5

The electrolyte was amino 6 methyl 2 pyridine in solution at 45 g per liter in dehydrated acetonitrile and without any supporting electrolyte. The potential of the COURTAULDS HT fibers was +1 volt relative to a 0.01M $Ag/Ag^+$ reference electrode in the acetonitrile. The temperature was 20° C., and the treatment setup was as shown in FIG. 1. The treatment duration was three minutes.

FIG. 11a shows the Cls peak of fibers treated in this way, FIG. 11b shows the Nls peak, FIG. 11c shows the negative SIMS spectrum and FIG. 11d shows the positive SIMS spectrum. From these it can be seen:

R(N)=3.8
R(O)=1
C=82.2%
N=5.1%
O=8.2%

The shoulder in the Cls peak shows that the carbon is bonded to atoms which are more electronegative than carbon. The energy position and the shape of the Nls peak indicate that nitrogen is in the form of $—NH_2$ or =NH groups, which is corroborated by the absence of ranges of peaks in positive SIMS.

Although the potential $V_t$ is low and although no supporting electrolyte is used, non-negligible grafting of nitrogen well localized on the surface of the fibers is observed (R(N)=3.8).

EXAMPLE 6

The electrolyte was ethylene diamine in solution at 12 g/liter in dehydrated dimethylformamide. 21 g lithium perchlorate per liter of solution were added as a supporting electrolyte. The COURTAULDS HT fibers were at a potential of either +1.45 volts relative to a saturated calomel reference electrode (ECS, equivalent to +1.15 volts relative to a 0.01M $Ag/Ag^+$ reference electrode in acetonitrile), or else +1.6 volts relative to the saturated calomel electrode (equivalent to +1.3 volts relative to $Ag/Ag^+$). The treatment temperature was 20° C. and the duration was 5 minutes. The experimental setup was as shown in FIG. 1.

The corresponding surface spectroscopic analyses (Table VI) were performed using apparatus different from that used in Examples 1 to 5, and in Examples 7 and 8. This second apparatus is calibrated so that the results obtained in the present example may be compared with the results mentioned in the other examples. In this case, the energy scale of the photoelectrons (ESCA) is taken relative to Mg Kα radiation and represents the kinetic energy thereof, whereas in the other examples, the X-axis represents the binding energy E.B of the photoelectrons with the atoms from which they were emitted.

TABLE VI

| | $V_t$ = +1.45 Volts/ECS Duration = 5 minutes | $V_t$ = +1.6 Volts/ECS Duration = 5 minutes |
|---|---|---|
| ESCA | C: 75.5% | C: 76% |
| | N: 13% | N: 11% |
| | O: 11.5% | O: 13% |
| $SIMS^-$ | R(N) = 6.0 | R(N) = 2.9 |
| | R(O) = 1.6 | R(O) = 0.21 |
| $SIMS^+$ | Chlorine and lithium present | |

Although less effective than the treatments mentioned in Example 4 (solvent=acetonitrile), treatments performed using dimethylformamide, in particular with $V_t=+1.45$ volts/ECS, provide considerable quantities of nitrogen localized on the actual surface of the fibers. The results for $V_t=+1.45$ volts/ECS is quite comparable to those mentioned in Example 1 (t=10 minutes and t=60 minutes) from the grafting point of view, but the treatment time is considerably shorter (5 min.).

Figure 12B:
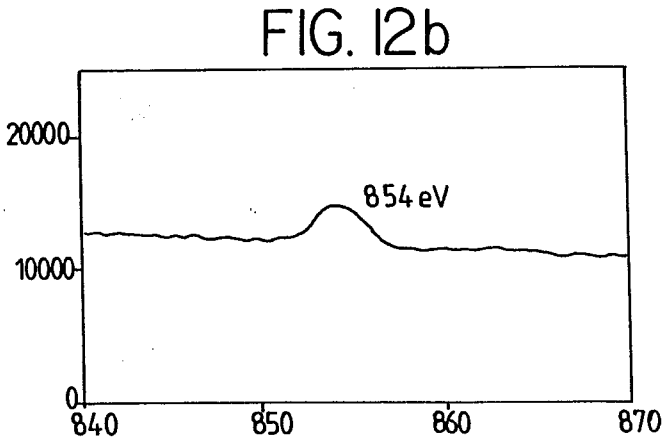
Figure 12A:
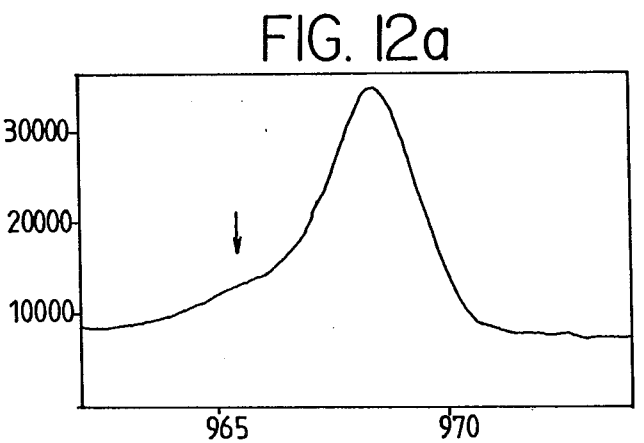
Figure 12D:
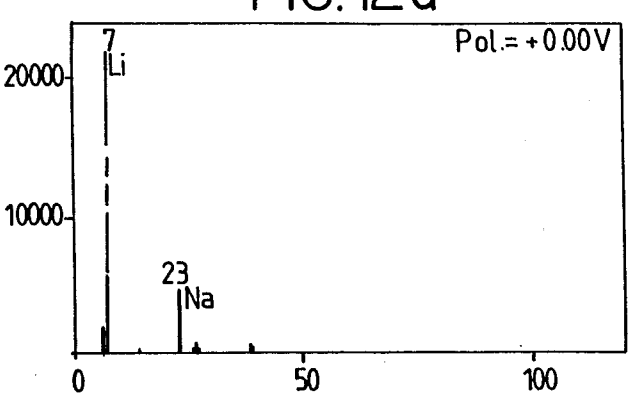
Figure 12C:
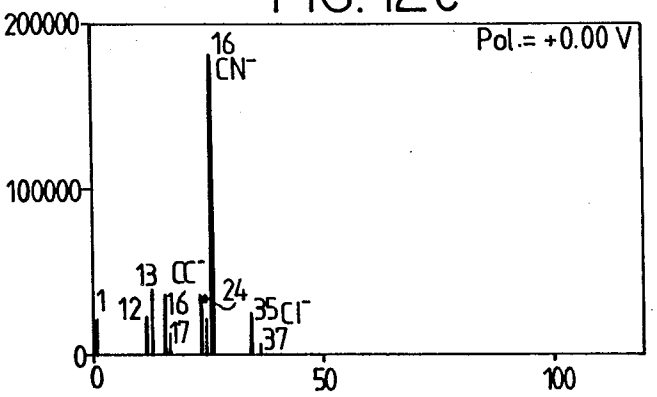

FIG. 12*a* shows the Cls peak after treatment at $V_t=+1.45$ volts/ECS. A large shoulder towards low kinetic energies (high binding energies in the atom) indicates that the carbon is chemically bonded to atoms which are more electronegative than the carbon. The Nls peak (FIG. 12*b*) is centered at E.B=339 eV (854 eV in kinetic energy terms), which is exactly the same value as that found for the Nls peak for 5 minutes of treatment in acetonitrile (Example 4, see FIG. 10*e*). Nitrogen is thus covalently bonded to the carbon. FIGS. 12*c* and 12*d* show the negative and positive SIMS spectra.

Figure 12F:
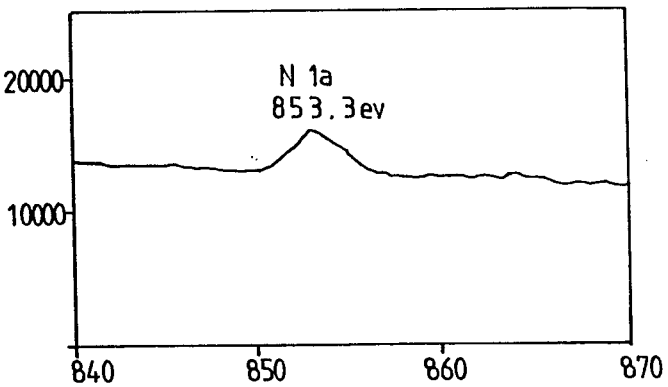
Figure 12H:
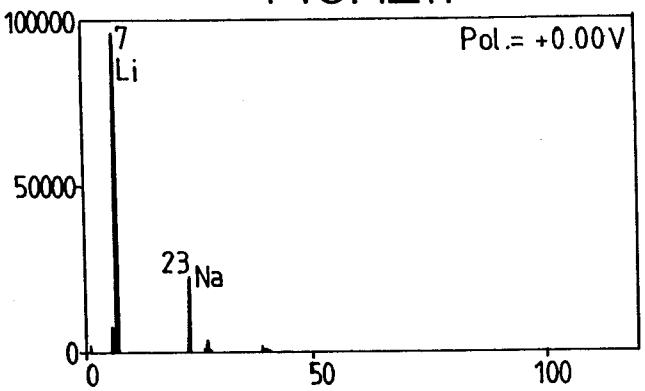
Figure 12E:
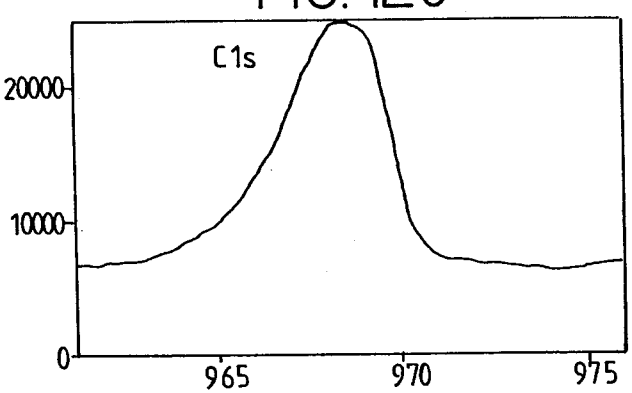
Figure 12G:
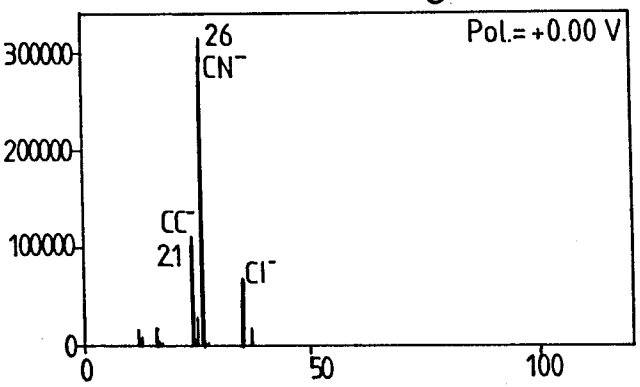

FIG. 12*e* shows the Cls peak for treatment with $V_t=+1.6$ volts/ECS. The half-height width is wider than for $V_t=+1.45$ volts/ECS. FIG. 12*f* shows the corresponding Nls peak, centered on E.B=399.8 eV, giving a shift of +0.7 eV relative to $V_t=+1.45$ volts. For oxygen E.B=534.1 eV compared with E.B=532 eV at $V_t=+1.45$ volts. This indicates that nitrogen, oxygen, and carbon are not in the same bonding state for these two treatments in dimethylformamide. FIGS. 12*g* and 12*h* show the negative and positive SIMS spectra.

In the negative SIMS spectrum (FIGS. 12*c* and 12*g*), the presence of chlorine (masses 35 and 37) can be observed, and in the positive SIMS spectra (FIGS. 12*d* and 12*h*) a very large peak due to lithium (masses 6 and 7) can be observed. Consequently, the lithium perchlorate is involved in the electrochemical reaction and it is not advantageous to come too close to $V_{SOL}$ (i.e. +2 volts for dimethylformamide+$LiClO_4$) since nitrogen grafting is less for $V_t=+1.6$ volts/ECS (R(N)=2.9, whereas R(N)=6 for $V_t=+1.45$ volts/ECS and respectively 11% and 13% of the nitrogen is fixed). However, the grafting is effective, with the nitrogen being localized on the surface in the form of $—NH_2$ or =NH groups. Since R(O) remains moderate, the oxygen remains beneath the surface. The decohesion stress measured using the Example 1 procedure and NARMCO 5208 resin is:

$$\tau_d = 103"3\ MPa$$

for $$V_t = +1.6 \text{ volts/ECS.}$$

Oxygen cannot participate significantly to the adhesion since R(O) is only 0.21.

EXAMPLE 7

The conditions of Example 1 are applied to a "high modulus" COURTAULDS' HMU fiber which was originally untreated and which was subjected to one hour of treatment with hexamethylene tetramine. Originally $\tau_d=15.2\pm1.7$ MPa (using CIBA GEIGY's LY 556 resin); after one hour of treatment $\tau_d=15.02\pm4.9$ MPa. This means that the surface of these fibers is inert with respect to the electrochemical reactions taking place in Example 1.

Figure 5:
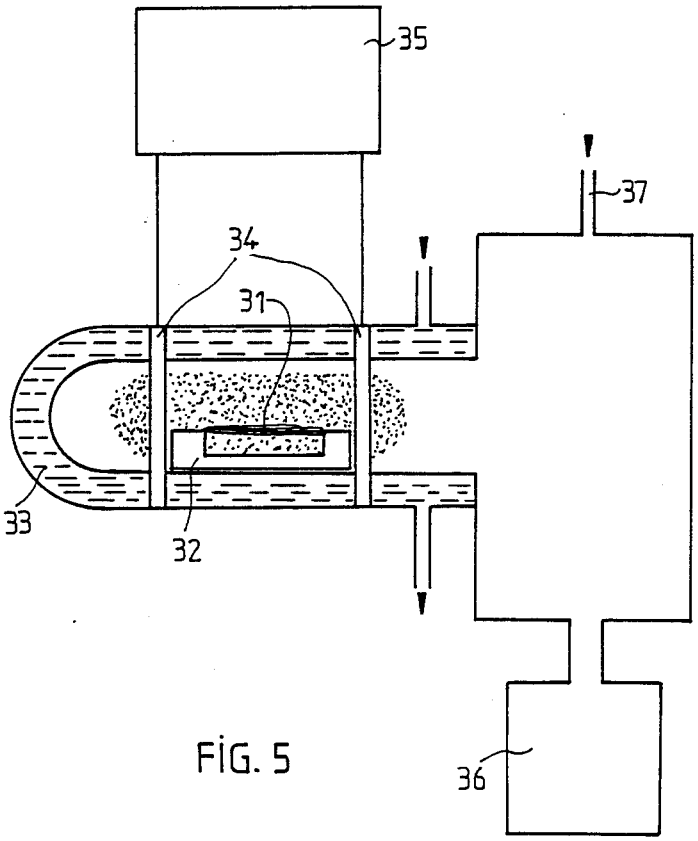
FIG. 5 is a diagram of a laboratory installation for treating carbon fibers by means of a nitrogen plasma.

These COURTAULDS' HMU fibers were exposed to the action of a nitrogen plasma generated by an electromagnetic wave at a frequency of 12.57 MHz. The laboratory experimental setup is shown in Figure 5.

A segment 31 of length 5 cm was disposed on a graphite support 32 disposed inside a cylindrical envelope 33 cooled by a flow of water. Two external annular electrodes 34 were connected to a high frequency generator 35. A pump 36 maintained a nitrogen pressure at about 15 Pa inside the enclosure by means of a controlled nitrogen microleak 37. The power dissipated in the nitrogen plasma was about 100 watts.

Plasma treatment may be performed continuously on a carbon fiber by means of a suitable installation, not shown.

It suffices to expose the COURTAULDS' HMU fibers to the action of the plasma for a period of 30 seconds for $\tau_d$ to go from 15.2±1.7 MPa to 64.7±7.4 MPa under the conditions of Example 1. The ion bombardment ejects carbon atoms from the large-sized aromatic structures carried on the surface of the fibers. Chemically active sites are thus created. They increase the surface reactivity of COURTAULDS' HMU fibers since both in ESCA and in SIMS nitrogen is not observed and the small addition of oxygen which is observed is completely insufficient for justifying the observed increase in $\tau_d$. Thus, the surface of these fibers becomes sufficiently reactive for CIBA GEIGY's LY 556 resin to adhere directly thereto without intervening surface functions. These plasma treated fibers have a surface structure which includes numerous defects. The reorganization of the electron clouds around the vacant carbon atoms leaves unsatisfied chemical bonds available. Direct bridging becomes possible between the fibers and the resin. A fortiori, the surface of the fibers is sufficiently activated to be sensitive to the action of electrochemical treatments such as those described above.

EXAMPLE 8

Originally untreated COURTAULDS' HT fibers and COURTAULDS' HT fibers treated under the conditions of Example 1 for a period of one hour were put into the presence of epichlorohydrin in a sealed vessel. The immersion took place for a duration of 22 hours at 120° C. epichlorohydrin has an epoxy group. The fibers were then cleaned three times in acetone in order to remove epichlorhydrine from the surface thereof.

Figure 15A:
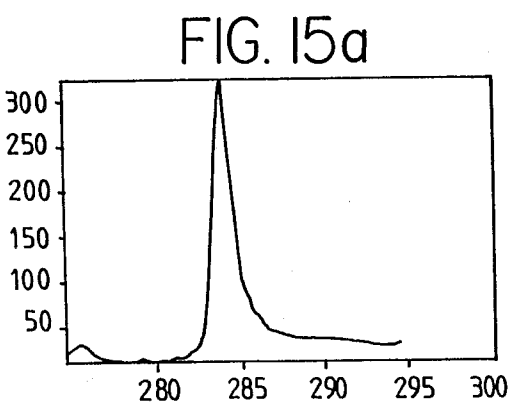
Figure 15B:
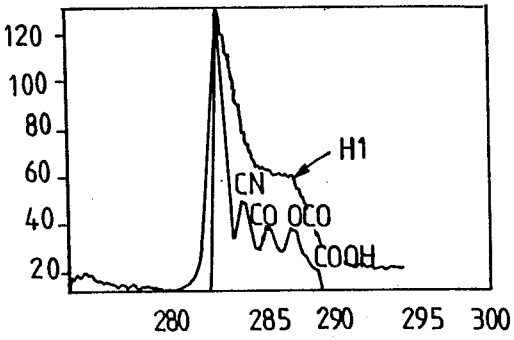
Figure 15C:
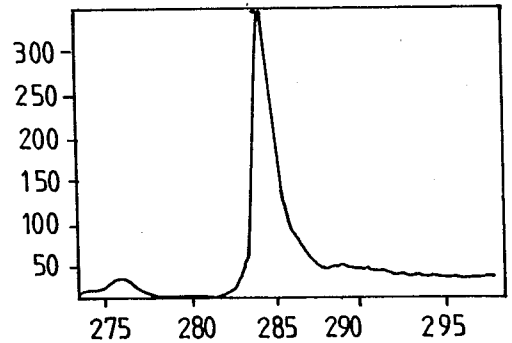

FIG. 15*a* shows the Cls peak (ESCA) of the untreated COURTAULDS' HT fibers. FIG. 15*b* shows the Cls peak after treatment with hexamethylene tetramine in an aqueous medium for one hour. FIG. 15*c* shows the Cls peak for the nontreated fibers after being subjected to the action of epichlorohydrin. Finally, FIG. 15*d* shows the Cls peak of the fibers that were subjected to hexamethylene tetramine surface treatment and to the action of epichlorohydrin.

Figure 15D:
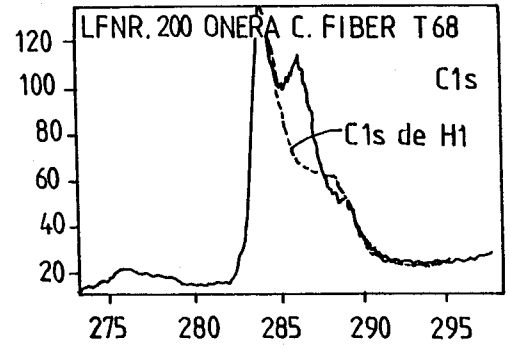

FIGS. 15*a* and 15*c* show that the untreated fibers do not fix epichlorohydrin, unlike the treated fibers (FIGS. 15*b* and 15*d*). A very large shoulder in the Cls peak of FIG. 15*d* shows that the epichlorohydrin is fixed covalently to the nitrogen carried on the surface of the fibers treated with hexamethylene tetramine, since after one hour of treatment (see Example 1) the surface comprises grafted =NH or $—NH_2$ groups only. The surface groups provide the interface cohesion via covalent carbon-nitrogen-resin bonds.

The above-described results lead us to believe that the observed effects relating to grafting nitrogenous groups or molecules stem from a general mechanism.

Anode oxidation of an amine (be that a primary, a secondary, or a tertiary, amine) when investigated electrochemically on a platinum anode generally passes via the formation of a cation radical followed by a cation. For example, for a primary amine where R is a group which is insensitive to oxido-reduction under the conditions of the experiment:

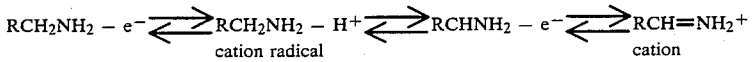

The existence of cation radicals has been observed by RAMAN infrared spectroscopy in a solution of acetonitrile containing tetramethylbenzidine and lithium perchlorate while using carbon fibers as an anode. The cation radicals appear when the first oxido-reduction potential of the amine is exceeded, and dications appear beyond the second potential.

Since the cations cannot exist in water, the carbon is attacked in an aqueous medium as soon as the cation radical is formed by means of the following mechanism which is applicable to primary and to secondary amines:

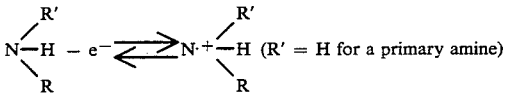

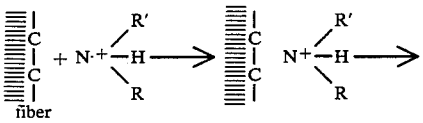

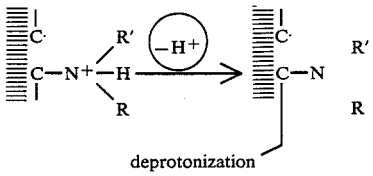

The carbon atoms in these reactions are the surface atoms of a fiber.

The radical C• may combine with a cation radical. Reactions are possible with the nucleophilic species present in the electrolytic solution, such as $OH^-$ ions:

$$C^{\bullet} - e^- \rightarrow C^+$$

$$C^+ + OH^- \rightarrow C{-}OH$$

$$C{-}OH - H^+ - e^- \rightarrow C{=}O$$

The last two reactions justify the presence of oxygen containing groups which remain in the minority on the actual surface of the fibers (in an aqueous medium).

For tertiary amines:

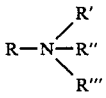

the deprotonizing step is replaced by eliminating one of the three groups R', R'', or R''':

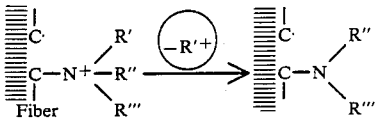

These mechanisms which apply in an aqueous medium also apply in a nonaqueous medium: the cation may be stable to some extent in the organic solvent and may react with the carbon of the fibers. The reactions imply that C• radicals and oxygen remain very much in the minority so long as the solvent has been suitably dehydrated.

These reactions take place if:

the working potential $V_t$ is greater than the oxidoreduction potential $V_E$ of the amine compound;

the working potential $V_t$ is less than the decomposition potential $V_O$ of water or $V_{SOL}$ of the nonaqueous solvent with its supporting electrolyte.

When operating in a nonaqueous medium:

the decomposition potential is displaced to higher potentials insofar as the optional supporting electrolyte used has a high electrochemical oxidation potential in the selected solvent;

$V_{SOL}$ is not reduced by compounds having low pKb as is the case for water;

nitrogenous groups such as $-NH_2$ and $=NH$ or entire molecules of amine compound serving as the electrolyte are the species which are grafted in the majority by means of a covalent bond;

the quantity of grafted nitrogenous surface groups is increased compared with treatment in an aqueous medium, and this happens in a shorter period of time, particularly when using acetonitrile;

the adhesion obtained is very high; and satisfying the above-mentioned potential conditions makes it possible to graft the widest variety of amine molecules on the surface of suitable categories of carbon or on the activated surface of carbon that has been treated by an appropriate process, such as the use of a plasma, for example.

We claim:

1. An electrochemical method of surface treating carbon, wherein the carbon is put into contact with a solution of an amine compound in a bipolar solvent and polarized positively relative to a cathode, said solvent being an organic solvent having a high anode oxidation potential, and said solution being practically free from water.

2. A method according to claim 1, wherein the amine compound is selected from: ethylenediamine; amino 6 methyl 2 pyridine; and tetramethylbenzidine.

3. A method according to claim 1, wherein the solvent is aprotic.

4. A method according to claim 3, wherein the organic solvent is selected from: acetonitrile; dimethylformamide; and dimethylsulfoxide.

5. A method according to claim 1, wherein a supporting electrolyte which also has a high anode oxidation potential is added to the solution.

6. A method according to claim 5, wherein the supporting electrolyte is selected from the group consisting of lithium perchlorate; tetraethylammonium perchlorate; tetrafluoroborates; alkali tetrafluorophosphates; and quaternary ammonium tetrafluorophosphates.

7. A method according to claim 1, wherein the polarization of the carbon is selected to be sufficiently low to avoid causing anodic oxidation of the bipolar organic solvent, but to be sufficiently high for the amine compound to be subjected to anodic oxidation.

8. A method according to claim 7, wherein the solution consists essentially of ethylenediamine, acetonitrile, and lithium perchlorate, and wherein the potential of the carbon relative to a 0.01M $Ag/Ag^+$ reference electrode is about 1.3 volts.

9. A method according to claim 7, wherein the solution consists essentially of ethylenediamine, dimethylformamide, and lithium perchlorate, and wherein the potential of the carbon relative to a saturated calomel reference electrode is about +1.45 v.

10. Treated carbon obtained by subjecting a carbon selected from the group consisting of microporous carbons, carbons capable of being graphitized at low temperature and surface activated carbons to a treatment wherein the carbon is put into contact with a solution of an amine compound in a bipolar solvent and polarized positively relative to a cathode, said solvent being an organic solvent having a high anode oxidation potential, and said solution being practically free from water.

11. Treated carbon according to claim 10, wherein its surface is activated by the action of a nitrogen plasma.

12. Treated carbon according to claim 10, wherein the carbon is in the form of carbon fibers.

13. A composite material comprising a matrix of synthetic resin reinforced by carbon fibers according to claim 12.

14. A composite material according to claim 13, wherein the matrix is an organic resin which is crosslinked by an amine hardener.

15. A method according to claim 5, wherein the polarization of the carbon is selected to be sufficiently low to avoid causing anodic oxidation of the bipolar organic solvent and of the supporting electrolyte, but to be sufficiently high for the amine compound to be subjected to anodic oxidation.

* * * * *